US010156199B2

(12) United States Patent
Nakano et al.

(10) Patent No.: US 10,156,199 B2
(45) Date of Patent: Dec. 18, 2018

(54) DRIVE SYSTEM AND DRIVE METHOD FOR FUEL INJECTION VALVES

(71) Applicant: TOYOTA JIDOSHA KABUSHIKI KAISHA, Toyota-shi (JP)

(72) Inventors: Tomohiro Nakano, Nagoya (JP); Eiji Murase, Nagoya (JP); Rihito Kaneko, Miyoshi (JP); Masanao Idogawa, Nagoya (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 395 days.

(21) Appl. No.: 14/901,153

(22) PCT Filed: Jun. 16, 2014

(86) PCT No.: PCT/IB2014/001075
§ 371 (c)(1),
(2) Date: Dec. 28, 2015

(87) PCT Pub. No.: WO2014/207523
PCT Pub. Date: Dec. 31, 2014

(65) Prior Publication Data

US 2016/0215721 A1 Jul. 28, 2016

(30) Foreign Application Priority Data

Jun. 24, 2013 (JP) ..... 2013-131814

(51) Int. Cl.
*F02D 41/20* (2006.01)
*F02D 41/24* (2006.01)

(52) U.S. Cl.
CPC ..... *F02D 41/20* (2013.01); *F02D 41/2451* (2013.01); *F02D 41/2467* (2013.01);
(Continued)

(58) Field of Classification Search
CPC ..... F02D 2041/2006; F02D 2041/2051; F02D 2041/2058; F02D 2200/0602;
(Continued)

(56) References Cited

U.S. PATENT DOCUMENTS 3,589,345 A * 6/1971 Benson ..... F02D 41/2096 123/478
5,947,078 A * 9/1999 Fujiwara ..... F02D 41/024 123/295
(Continued)

FOREIGN PATENT DOCUMENTS

DE 198 13 138 A1 9/1999
DE 10 2010 040 123 A1 3/2011
(Continued)

OTHER PUBLICATIONS

International Search Report dated Jan. 20, 2015 in PCT/IB2014/001075.

*Primary Examiner* — David Hamaoui
*Assistant Examiner* — Carl Staubach
(74) *Attorney, Agent, or Firm* — Oblon, McClelland, Maier & Neustadt, L.L.P.

(57) ABSTRACT

A drive control circuitry and an electronic control circuitry for controlling energization of a plurality of fuel injection valves. The plurality of fuel injection valves including a second fuel injection valve currently injecting fuel and a first fuel injection valve which, of the plurality of fuel injection valves, was last energized before the second fuel injection valve. When an energization start interval between a start of energization of the first fuel injection valve and a start of energization of the second fuel injection valve is longer than or equal to a peak reaching time of the first fuel injection valve, an energization time of the second fuel injection valve is extended as the energization start interval reduces. When the energization start interval is shorter than the peak reach-
(Continued)

ing time, the energization time of the second fuel injection valve is reduced as the energization start interval reduces.

15 Claims, 12 Drawing Sheets

(52) U.S. Cl.
CPC ..... *F02D 2041/2006* (2013.01); *F02D 2041/2051* (2013.01); *F02D 2041/2058* (2013.01); *F02D 2200/0602* (2013.01); *F02D 2200/503* (2013.01)

(58) Field of Classification Search
CPC ..... F02D 2200/503; F02D 41/20; F02D 41/2451; F02D 41/2467; F02D 2041/2003; F02D 2041/2017; F02D 2041/2024
USPC ..... 123/490, 478
See application file for complete search history.

(56) References Cited

U.S. PATENT DOCUMENTS 6,332,455 B1 * 12/2001 Sumida ..... F02D 41/20 123/490
6,360,725 B1 3/2002 Scherrbacher
7,395,807 B2 * 7/2008 Watanabe ..... F02D 41/0087 123/305
9,200,584 B2 * 12/2015 Jung ..... F02D 41/2425
2005/0126534 A1 * 6/2005 Kikutani ..... F02D 41/20 123/299
2005/0229898 A1 * 10/2005 Kikutani ..... F02D 41/20 123/299
2008/0184968 A1 8/2008 Matsuura
2010/0204902 A1 * 8/2010 Kuroki ..... F02D 41/042 701/103
2013/0112172 A1 * 5/2013 Toyohara ..... F02D 41/345 123/478
2016/0108847 A1 * 4/2016 Nakano ..... F02D 41/20 123/490
2016/0131074 A1 * 5/2016 Nakano ..... F02D 41/20 137/2
2017/0226950 A1 * 8/2017 Tanaka ..... F02D 41/2467

FOREIGN PATENT DOCUMENTS

EP 1 953 372 A2 8/2008
JP 2004-251149 A 9/2004
JP 2006-200510 A 8/2006
JP 2010-265822 A 11/2010
JP 2011-163312 A 8/2011

* cited by examiner

DRIVE SYSTEM AND DRIVE METHOD FOR FUEL INJECTION VALVES

BACKGROUND OF THE INVENTION

1. Field of the Invention

The invention relates to a drive system and drive method for fuel injection valves, which cause the fuel injection valves provided in an internal combustion engine to open or close.

2. Description of Related Art

There is known a drive system including a step-up circuit that steps up the voltage of a battery and a capacitor that is charged with the voltage stepped up by the step-up circuit. In the thus configured drive system, one of the capacitor and the battery is selectively used as a power supply for fuel injection valves.

For example, Japanese Patent Application Publication No. 2004-251149 (JP 2004-251149 A) describes that a fuel injection valve is energized by a capacitor that is able to apply a voltage higher than that of a battery from energization start timing to the timing at which a predetermined time elapses and, after that, the fuel injection valve is energized by the battery. JP 2004-251149 A also describes that, when the power supply is changed from the capacitor to the battery, the capacitor is charged with current supplied from the battery, the voltage of the capacitor, decreased as a result of energization of the fuel injection valve, is recovered.

SUMMARY OF THE INVENTION

At the time of sequentially injecting fuel from a plurality of fuel injection valves, there is a case where the interval between the energization start timing of one of the fuel injection valves, which currently injects fuel, and the energization start timing of the last fuel injection valve that has started fuel injection immediately before the current fuel injection is extremely short. In this case, energization of the current fuel injection valve may be started in a state where the voltage of the capacitor is still lower than an upper limit voltage that is determined on the basis of the capacitance of the capacitor.

That is, when the interval of the start of energization is extremely short, energization of the current fuel injection valve from the capacitor may be started while the last fuel injection valve is being energized from the capacitor or while the voltage of the capacitor is being recovered through charging of the capacitor from the battery. In this case, energization of the current fuel injection valve is started in a state where the voltage of the capacitor is lower than the upper limit voltage. Thus, in comparison with the case where energization of the current fuel injection valve is started in a state where the voltage of the capacitor is at a level equal to the upper limit voltage, the rate of increase in exciting current flowing through a solenoid of the fuel injection valve becomes slow, and there occurs a delay in the opening of the fuel injection valve. Thus, the injection amount of fuel may reduce.

As a method of suppressing a reduction in the injection amount of fuel due to such a delay in the opening of a fuel injection valve, a method is conceivable, in which the voltage of the capacitor is monitored with the use of a detection system, such as a sensor, and an energization time of each fuel injection valve is set on the basis of the detected value of voltage, detected by the detection system. With this method, by extending the energization time of each fuel injection valve as the detected value of voltage, detected by the detection system, decreases, it is possible to suppress a reduction in the injection amount of fuel.

However, the rate of change in the voltage of the capacitor when each fuel injection valve is energized from the capacitor or when the capacitor is recovered through charging is significantly high, so the above-described detection system may not be able to monitor such a change in the voltage of the capacitor. For example, when each fuel injection valve is energized from the capacitor, there occurs a delay in detection of the voltage of the capacitor with the use of the detection system, so the detected value of the voltage, which is detected by the detection system, tends to be a value higher than an actual voltage of the capacitor. An energization time, set by using the detected value indicating a value higher than an actual voltage in this way, is shorter than an energization time based on the actual voltage of the capacitor. Therefore, when each fuel injection valve is controlled on the basis of the energization time set by using the detected value of the voltage, it may not be able to inject fuel from each fuel injection valve in an adequate amount appropriate to a required injection amount.

The invention provides a drive system and drive method for fuel injection valves, which are able to cause the fuel injection valves to inject fuel in an adequately amount appropriate to a required injection amount by bringing an energization time of each fuel injection valve to the length of time appropriate to an actual voltage of a capacitor at energization start timing.

A first aspect of the invention provides a drive system for fuel injection valves. The drive system includes a battery, a capacitor, a drive control circuitry, and an electronic control circuitry. The capacitor is configured to be charged with electric power that is supplied from the battery. The drive control circuitry is configured to selectively use one of the battery and the capacitor as a power supply, and to open or close the plurality of fuel injection valves by controlling energization of the plurality of fuel injection valves from one of the battery and the capacitor. The plurality of fuel injection valves includes a second fuel injection valve currently injecting fuel and a first fuel injection valve which, of the plurality of fuel injection valves, last started energizing before the second fuel injection valve. The energization of the second fuel injection valve starts while the energization of the first fuel injection valve continues. The electronic control circuitry is configured to: (a) cause the plurality of fuel injection valves to inject fuel by energizing the plurality of fuel injection valves through control over the drive control circuitry, (b) when an energization start interval between a start of energization of the first fuel injection valve and a start of energization of the second fuel injection valve is longer than or equal to a peak reaching time of the first fuel injection valve at the time when fuel is sequentially injected from the plurality of fuel injection valves, extend an energization time of the second fuel injection valve as the energization start interval reduces, and (c) when the energization start interval is shorter than the peak reaching time, reduce the energization time of the second fuel injection valves as the energization start interval reduces. The peak reaching time is a time interval between a first energization start timing and a peak reach timing. The first energization start timing is a timing of the start of energization of first fuel injection valve. The peak reach timing is a timing at which exciting current flowing through a solenoid of the first fuel injection valve reaches a peak current value that is set at the time of fuel injection of the first fuel injection valve. The energization start interval is a time interval between the first energization start timing and second energization start timing that is timing of the start of energization of the second fuel injection valve.

With the drive system according to the first aspect of the invention, when energization of each of the fuel injection valves is ended, the voltage of the capacitor is recovered through charging with electric power that is supplied from the battery. Thus, when the energization start interval that is a time interval between the first energization start timing and the second energization start timing is longer than or equal to the peak reaching time that is a time interval from the first energization start timing to the peak reach timing, the time during which it is allowed to recover the voltage of the capacitor reduces as the energization start interval reduces. Therefore, when the energization start interval is longer than or equal to the peak reaching time, it may be estimated that the voltage of the capacitor at the second energization start timing decreases as the energization start interval reduces.

Depending on the injection mode of each fuel injection valve, the energization start interval may be shorter than the peak reaching time because of the significantly short energization start interval. That is, while any one of the fuel injection valves is still being energized from the capacitor, energization of another one of the fuel injection valves, which carries out fuel injection subsequently, may be started from the capacitor. In this case, energization of the fuel injection valve, which carries out fuel injection subsequently, from the capacitor is started without waiting for a start of recovery of the voltage of the capacitor through charging. Therefore, when the energization start interval is shorter than the peak reaching time, the voltage of the capacitor at the second energization start timing may be estimated that the voltage decreases as the energization start interval extends.

Therefore, in the above configuration, the energization time of the fuel injection valve of which energization is started from the second energization start timing is extended as the energization start interval reduces when the energization start interval is longer than or equal to the peak reaching time. In addition, the energization time of the fuel injection valve of which energization is started from the second energization start timing is reduced as the energization start interval reduces when the energization start interval is shorter than the peak reaching time. By considering the relationship between the energization start interval and the peak reaching time in this way, it is possible to set the energization time of the second fuel injection valve of which energization is started from the second energization start timing in consideration of an actual mode of decrease in the voltage of the capacitor from the first energization start timing that is the energization start timing of the first fuel injection valve. That is, different from the case where the energization time is set on the basis of the detected value of the voltage of the capacitor, which is detected by a detection system, such as a sensor, it is possible to set the energization time without any influence of a deviation between the actual rate of change in the voltage of the capacitor and the rate of change in the detected value of the voltage, which is detected by the detection system. Therefore, by setting the energization time on the basis of the energization start interval and the peak reaching time, it is possible to bring the energization time close to a time appropriate to the actual voltage of the capacitor at the second energization start timing. By controlling each fuel injection valve on the basis of the above energization time, it is possible to cause each fuel injection valve to inject fuel in an adequate amount appropriate to the required injection amount.

In the drive system according to the first aspect of the invention, the electronic control circuitry may be configured to: (d) when the energization start interval is longer than or equal to the peak reaching time, decrease a voltage estimated value of the capacitor at the second energization start timing as the energization start interval reduces, (e) when the energization start interval is shorter than the peak reaching time, increase the voltage estimated value of the capacitor at the second energization start timing as the energization start interval reduces, and (f) extend an energization time of the current one of the fuel injection valves, of which energization is started from the second energization start timing, as the voltage estimated value of the capacitor at the second energization start timing decreases.

When the energization start interval is longer than or equal to the peak reaching time, energization of the fuel injection valve by the capacitor is started after energization of the last fuel injection valve ends. Therefore, it is allowed to recover the voltage of the capacitor by charging the capacitor with electric power supplied from the battery in a period from the peak reach timing to the second energization start timing. At this time, a time during which it is allowed to recover the voltage of the capacitor reduces as the energization start interval reduces. Thus, it may be estimated that the voltage of the capacitor at the second energization start timing decreases as the time during which it is allowed to recover the voltage of the capacitor reduces, that is, as the energization start interval reduces. Therefore, in the above configuration, when the energization start interval is longer than or equal to the peak reaching time, the voltage estimated value of the capacitor at the second energization start timing is decreased as the energization start interval reduces. Thus, when the energization start interval is longer than or equal to the peak reaching time, it is possible to calculate the voltage estimated value of the capacitor at the second energization start timing in consideration of recovery of the voltage of the capacitor through charging.

On the other hand, when the energization start interval is shorter than the peak reaching time, energization of one of the fuel injection valves from the capacitor is started while energization of the another one of the fuel injection valves is being energized from the capacitor. In the case where the another one of the fuel injection valves is being energized from the capacitor, the voltage of the capacitor decreases with a lapse of time from the first energization start timing. Thus, it may be estimated that the voltage of the capacitor at the second energization start timing increases as the energization start interval reduces. Therefore, in the above configuration, when the energization start interval is shorter than the peak reaching time, the voltage estimated value of the capacitor at the second energization start timing is increased as the energization start interval reduces. Thus, when the energization start interval is shorter than the peak reaching time, it is possible to calculate the voltage estimated value of the capacitor at the second energization start timing in consideration of the fact that the voltage decreases as the energization start interval extends.

By setting the energization time of the fuel injection valve of which energization is started from the second energization start timing on the basis of the voltage estimated value of the capacitor, calculated as described above, it is possible to appropriately adjust the fuel injection amount from the fuel injection valve.

In the drive system according to the first aspect of the invention, the electronic control circuitry may be configured to, when the energization start interval is longer than or equal to the peak reaching time, calculate the voltage estimated value of the capacitor at the second energization start timing by adding a value, obtained by subtracting a voltage decrease amount from a value of voltage of the capacitor at the first energization start timing, and a value, obtained by multiplying a value of the energization start interval by a capacitor voltage increase rate, together. The voltage decrease amount may be an amount of decrease in the voltage of the capacitor through energization of the first fuel injection valve from the capacitor in a period from the first energization start timing to the peak reach timing. The capacitor voltage increase rate may be a rate of recovery of the voltage of the capacitor at the time when the voltage of the capacitor is recovered through charging of the capacitor with electric power that is supplied from the battery. The among of decrease in the voltage of the capacitor corresponds to the amount of electric charge supplied from the capacitor to the solenoid of the first fuel injection valve in a period from the first energization start timing to the peak reach timing, and a product obtained by multiplying the value of the energization start interval by the capacitor voltage increase rate corresponds to the amount of electric charge stored in the capacitor from the battery in a period from the first energization start timing to the second energization start timing. Therefore, when the energization start interval is longer than or equal to the peak reaching time, it is possible to calculate the voltage estimated value of the capacitor at the second energization start timing in consideration of both the amount of decrease in the voltage of the capacitor up to the peak reach timing and the amount of recovery of the voltage of the capacitor through charging thereafter by executing the calculation process for adding the amount of decrease in the voltage of the capacitor and the product together.

On the other hand, when the energization start interval is shorter than the peak reaching time, energization of the fuel injection valve, which carries out fuel injection subsequently, from the capacitor is started while the another one of the fuel injection valves is being energized from the capacitor. That is, there is no period for recovery of the voltage of the capacitor between the first energization start timing and the second energization start timing. Therefore, if it is possible to estimate the amount of electric charge that is discharged from the capacitor in a period from the first energization start timing to the second energization start timing or a value corresponding to this amount, it is possible to estimate the voltage of the capacitor at the second energization start timing. That is, as the amount of electric charge that is discharged from the capacitor in a period from the first energization start timing to the second energization start timing or a value corresponding to this amount reduces, it may be estimated that the voltage of the capacitor at the second energization start timing increases.

In the drive system according to the first aspect of the invention, the electronic control circuitry may be configured to, when the energization start interval is longer than or equal to the peak reaching time, calculate the voltage estimated value of the capacitor at the second energization start timing by adding a value, obtained by subtracting a voltage decrease amount from a value of voltage of the capacitor at the first energization start timing, and a value, obtained by multiplying a value of the energization start interval by a capacitor voltage increase rate, together. In this case, the above product becomes a value corresponding to the amount of electric charge that is supplied from the capacitor to the fuel injection valve in a period from the first energization start timing to the second energization start timing. Therefore, when the energization start interval is shorter than the peak reaching time, it is possible to calculate the voltage estimated value of the capacitor at the second energization start timing in consideration of the amount of decrease in the voltage based on the amount of electric charge that is discharged from the capacitor in a period from the first energization start timing to the second energization start timing by executing the calculation process on the basis of the above product.

A time during which the fuel injection valve is energized from the capacitor extends as the peak reaching time extends, so it is possible to estimate that the voltage of the capacitor is low at the peak reach timing at which energization of the fuel injection valve from the capacitor is ended. In the drive system according to the first aspect of the invention, the electronic control circuitry may be configured to calculate the voltage decrease amount such that the voltage decrease amount increases as the peak reaching time extends. Thus, it is possible to calculate the voltage decrease amount in consideration of the influence due to the length of the peak reaching time.

As the peak current value set for fuel injection of the first fuel injection valve increases, a larger current flows through the solenoid of the another one of the fuel injection valves, so the amount of electric charge that is supplied from the capacitor to the another one of the fuel injection valves increases. In this way, as the amount of electric charge that is supplied from the capacitor to the last fuel injection valve increases, the voltage decrease amount increases. In the drive system according to the first aspect of the invention, the electronic control unit may be configured to calculate the voltage decrease amount such that the voltage decrease amount increases as the peak current value set for fuel injection from the first fuel injection valve increases. By calculating the voltage decrease amount in this way, it is possible to calculate the voltage decrease amount in consideration of the influence due to the magnitude of the peak current value.

When a constant amount of electric charge is supplied from the capacitor to an object having an equivalent resistance value, the voltage of the capacitor having a small capacitance decreases more easily than the voltage of the capacitor having a large capacitance. Therefore, the voltage decrease amount can vary with the capacitance of the capacitor that energizes each fuel injection valve. In the drive system according to the first aspect of the invention, the electronic control circuitry may be configured to calculate the voltage decrease amount such that the voltage decrease amount increases as a capacitance of the capacitor reduces. By calculating the voltage decrease amount in this way, it is possible to calculate the voltage decrease amount in consideration of the influence due to the capacitance of the capacitor.

The rate of increase in the exciting current flowing through the solenoid of the fuel injection valve can vary with the resistance value, or the like, of the solenoid at that timing. The rate of increase in the exciting current decreases as the resistance value of the solenoid increases, so the peak reaching time tends to extend. In the drive system according to the first aspect of the invention, the electronic control circuitry may be configured to calculate a value of the peak reaching time such that the value of the peak reaching time increases as a time from the first energization start timing to rising detection timing extends. The rising detection timing may be timing at which the exciting current flowing through the solenoid of the first fuel injection valve exceeds a prescribed current value smaller than the peak current value in process in which the exciting current increases. By calculating the peak reaching time in this way, it is possible to calculate the peak reaching time in consideration of the rate of increase in the exciting current at that time.

As the peak current value increases, a time until the exciting current flowing through the solenoid of the fuel injection valve reaches the peak current value tends to extend. That is, the peak reaching time is allowed to be estimated on the basis of the magnitude of the peak current value set for fuel injection of the fuel injection valve. In the drive system according to the first aspect of the invention, the electronic control circuitry may be configured to calculate the peak reaching time such that the peak reaching time extends as the peak current value increases. By calculating the peak reaching time in this way, it is possible to calculate the peak reaching time in consideration of the influence of the magnitude of the peak current value set for fuel injection from the fuel injection valve.

In terms of the characteristic of the capacitor, the voltage of the capacitor tends to fluctuate as the capacitance of the capacitor reduces. In the drive system according to the first aspect of the invention, the electronic control circuitry may be configured to calculate the capacitor voltage increase rate such that the capacitor voltage increase rate increases as a capacitance of the capacitor reduces. By using the thus calculated capacitor voltage increase rate, it is possible to highly accurately estimate the voltage of the capacitor at the second energization start timing in consideration of the influence due to a variation in the capacitance of the capacitor.

At the time of charging the capacitor, it is possible to more quickly end charging of the capacitor as the voltage of the battery that serves as the power supply increases. Therefore, it may be estimated that the capacitor voltage increase rate increases as the voltage of the battery increases. In the drive system according to the first aspect of the invention, the electronic control circuitry may be configured to calculate the capacitor voltage increase rate such that the capacitor voltage increase rate increases as a voltage of the battery increases. By using the thus calculated capacitor voltage increase rate, it is possible to highly accurately estimate the voltage of the capacitor at the second energization start timing in consideration of the influence due to a variation in the voltage of the battery.

Incidentally, when the same amount of electric charge is supplied from the capacitor to an object having an equivalent resistance value, the voltage of the capacitor having a small capacitance decreases more easily than the voltage of the capacitor having a large capacitance. Therefore, the capacitance of the capacitor is allowed to be estimated on the basis of the rate of decrease in the voltage of the capacitor at the time when each fuel injection valve is being energized from the capacitor.

The rate of decrease in the detected value of the voltage, which is detected by the detection system, such as a sensor, tends to decrease as compared to the actual rate of decrease in the voltage, and varies on the basis of the capacitance of the capacitor. That is, by using the rate of decrease in the detected value of the voltage, it is possible to detect the tendency as to whether the capacitance of the capacitor is large or small.

In the drive system according to the first aspect of the invention, the electronic control circuitry may be configured to: (g) calculate a learning value of the capacitance of the capacitor; and (h) calculate the learning value of the capacitance of the capacitor such that the learning value reduces as a rate of decrease in a detected value of the voltage of the capacitor at the time when each of the fuel injection valves is energized from the capacitor increases. Thus, it is possible to estimate the capacitance of the capacitor at that timing. By using the above capacitance of the capacitor, it is possible to highly accurately estimate the voltage of the capacitor at the second energization start timing in consideration of the capacitance of the capacitor.

Incidentally, the timing at which each fuel injection valve actually opens tends to delay as the fuel pressure in the delivery pipe in which fuel that is supplied to each fuel injection valve is stored increases. Therefore, when the energization start interval is shorter than the peak reaching time in a state where the fuel pressure in the delivery pipe is high, the last fuel injection valve may not have opened yet at the second energization start timing.

When the energization start interval is shorter than the peak reaching time, energization of the second fuel injection valve, which carries out fuel injection subsequently, from the capacitor is started while the first fuel injection valve is being energized from the capacitor. In this case, because the capacitor energizes the plurality of fuel injection valves, the rate of increase in the exciting current flowing through the solenoid of the first fuel injection valve and the solenoid of the second fuel injection valve after the second energization start timing is lower than the rate of increase in the exciting current before the second energization start timing. Therefore, when the first fuel injection valve has not opened yet at the second energization start timing because the fuel pressure in the delivery pipe is high, a delay in the opening of the last fuel injection valve can occur due to the start of energization of the second fuel injection valve.

In the drive system according to the first aspect of the invention, the electronic control circuitry may be configured to, when the energization start interval is shorter than the peak reaching time, extend an energization time of the first fuel injection valve as a fuel pressure in a delivery pipe increases. Thus, it is possible to correct the energization time of the first fuel injection valve in consideration of a change in the rate of increase in the exciting current flowing through the solenoid of the first fuel injection valve before and after the second energization start timing, and the fuel pressure in the delivery pipe. By controlling the first fuel injection valve on the basis of the thus corrected energization time, it is possible to cause the first fuel injection valve to inject fuel in an adequate amount.

The above-described delay in the opening of the first fuel injection valve due to the start of energization of the second fuel injection valve tends to occur as the energization start interval reduces. In the drive system according to the first aspect of the invention, the electronic control circuitry may be configured to, when the energization start interval is shorter than the peak reaching time, extend an energization time of the first fuel injection valve as the energization start interval reduces. Thus, even when energization of the second fuel injection valve from the capacitor is started at the time when the first fuel injection valve has not opened yet because of the short energization start interval, it is possible to cause the first fuel injection valve to inject fuel in an adequate amount by correcting the energization time of the first fuel injection valve on the basis of the energization start interval and controlling the first fuel injection valve on the basis of the corrected energization time.

A second aspect of the invention provides a drive method for fuel injection valves. A capacitor is configured to be charged with electric power that is supplied from a battery. A drive control circuitry is configured to selectively use one of the battery and the capacitor as a power supply and to open or close the plurality of fuel injection valves by controlling energization of the plurality of fuel injection valves from one of the battery and the capacitor. An electronic control circuitry is configured to cause the plurality of fuel injection valves to inject fuel by energizing the plurality of fuel injection valves through control over the drive control circuitry. The drive method includes: (a) controlling the drive control circuitry with the use of the electronic control circuitry such that the plurality of fuel injection valves are caused to sequentially inject fuel by energizing the plurality of fuel injection valves; (b) controlling the drive control circuitry with the use of the electronic control circuitry such that, when an energization start interval between a start of energization of a first fuel injection valve, of which energization is started first, and a start of energization of a second fuel injection valve, of which energization is started subsequently, is longer than or equal to a peak reaching time of the first fuel injection valve an energization time of the second fuel injection valve is extended as the energization start interval reduces, and (c) controlling the drive control circuitry with the use of the electronic control circuitry such that, when the energization start interval is shorter than the peak reaching time, the energization time of the second fuel injection valves is extended as the energization start interval reduces. The peak reaching time is a time interval between first energization start timing and peak reach timing. The first energization start timing is timing of a start of energization of the first fuel injection valve. The peak reach timing is timing at which exciting current flowing through a solenoid of the first fuel injection valve reaches a peak current value that is set at the time of fuel injection of the first fuel injection valve. The energization start interval is a time interval between the first energization start timing and second energization start timing that is timing of the start of energization of the second fuel injection valve.

In the drive method according to the second aspect of the invention, when the energization start interval is longer than or equal to the peak reaching time, a voltage estimated value of the capacitor at the second energization start timing may be calculated with the use of the electronic control circuitry so as to decrease as the energization start interval reduces. When the energization start interval is shorter than the peak reaching time, the voltage estimated value of the capacitor at the second energization start timing may be calculated with the use of the electronic control circuitry so as to increase as the energization start interval reduces. The drive control circuitry may be controlled with the use of the electronic control circuitry such that the energization time of the current one of the fuel injection valves, of which energization is started from the second energization start timing, extends as the voltage estimated value of the capacitor at the second energization start timing decreases.

In the drive method according to the second aspect of the invention, when the energization start interval is longer than or equal to the peak reaching time, the voltage estimated value of the capacitor at the second energization start timing may be calculated with the use of the electronic control circuitry by adding a value, obtained by subtracting a voltage decrease amount from a value of voltage of the capacitor at the first energization start timing, and a value, obtained by multiplying a value of the energization start interval by a capacitor voltage increase rate, together. The voltage decrease amount may be an amount of decrease in the voltage of the capacitor through energization of the first fuel injection valve from the capacitor in a period from the first energization start timing to the peak reach timing. The capacitor voltage increase rate may be a rate of recovery of the voltage of the capacitor at the time when the voltage of the capacitor is recovered through charging of the capacitor with electric power that is supplied from the battery.

In the drive method according to the second aspect of the invention, when the energization start interval is shorter than the peak reaching time, the voltage estimated value of the capacitor at the second energization start timing may be calculated with the use of the electronic control circuitry so as to decrease as a value obtained by multiplying a value, obtained by dividing a value of the energization start interval by a value of the peak reaching time, by a voltage decrease amount increases. The voltage decrease amount may be an amount of decrease in the voltage of the capacitor through energization of the first fuel injection valve from the capacitor in a period from the first energization start timing to the peak reach timing.

In the drive method according to the second aspect of the invention, the voltage decrease amount may be calculated with the use of the electronic control circuitry such that the voltage decrease amount increases as the peak reaching time extends.

In the drive method according to the second aspect of the invention, the voltage decrease amount may be calculated with the use of the electronic control circuitry such that the voltage decrease amount increases as the peak current value set for fuel injection from the first fuel injection valve increases.

In the drive method according to the second aspect of the invention, the voltage decrease amount may be calculated with the use of the electronic control circuitry such that the voltage decrease amount increases as a capacitance of the capacitor reduces.

In the drive method according to the second aspect of the invention, a value of the peak reaching time may be calculated with the use of the electronic control circuitry such that the value of the peak reaching time increases as a time from the first energization start timing to rising detection timing extends. The rising detection timing may be timing at which the exciting current flowing through the solenoid of the first fuel injection valve exceeds a prescribed current value smaller than the peak current value in process in which the exciting current increases.

In the drive method according to the second aspect of the invention, the peak reaching time may be calculated with the use of the electronic control circuitry such that the peak reaching time extends as the peak current value increases.

In the drive method according to the second aspect of the invention, the capacitor voltage increase rate may be calculated with the use of the electronic control circuitry such that the capacitor voltage increase rate increases as a capacitance of the capacitor reduces.

In the drive method according to the second aspect of the invention, the capacitor voltage increase rate may be calculated with the use of the electronic control circuitry such that the capacitor voltage increase rate increases as a voltage of the battery increases.

In the drive method according to the second aspect of the invention, a learning value of the capacitance of the capacitor may be calculated with the use of the electronic control circuitry such that the learning value reduces as a rate of decrease in a detected value of the voltage of the capacitor at the time when each of the fuel injection valves is energized from the capacitor increases.

In the drive method according to the second aspect of the invention, the drive control circuitry may be controlled with the use of the electronic control circuitry such that, when the energization start interval is shorter than the peak reaching time, an energization time of the last one of the fuel injection valves is extended as a fuel pressure in a delivery pipe increases.

In the drive method according to the second aspect of the invention, the drive control circuitry may be controlled with the use of the electronic control circuitry such that, when the energization start interval is shorter than the peak reaching time, an energization time of the first fuel injection valve is extended as the energization start interval reduces.

With the drive method according to the second aspect of the invention, as in the case of the first aspect of the invention, it is possible to cause each fuel injection valve to inject fuel in an adequate amount appropriate to the required injection amount.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
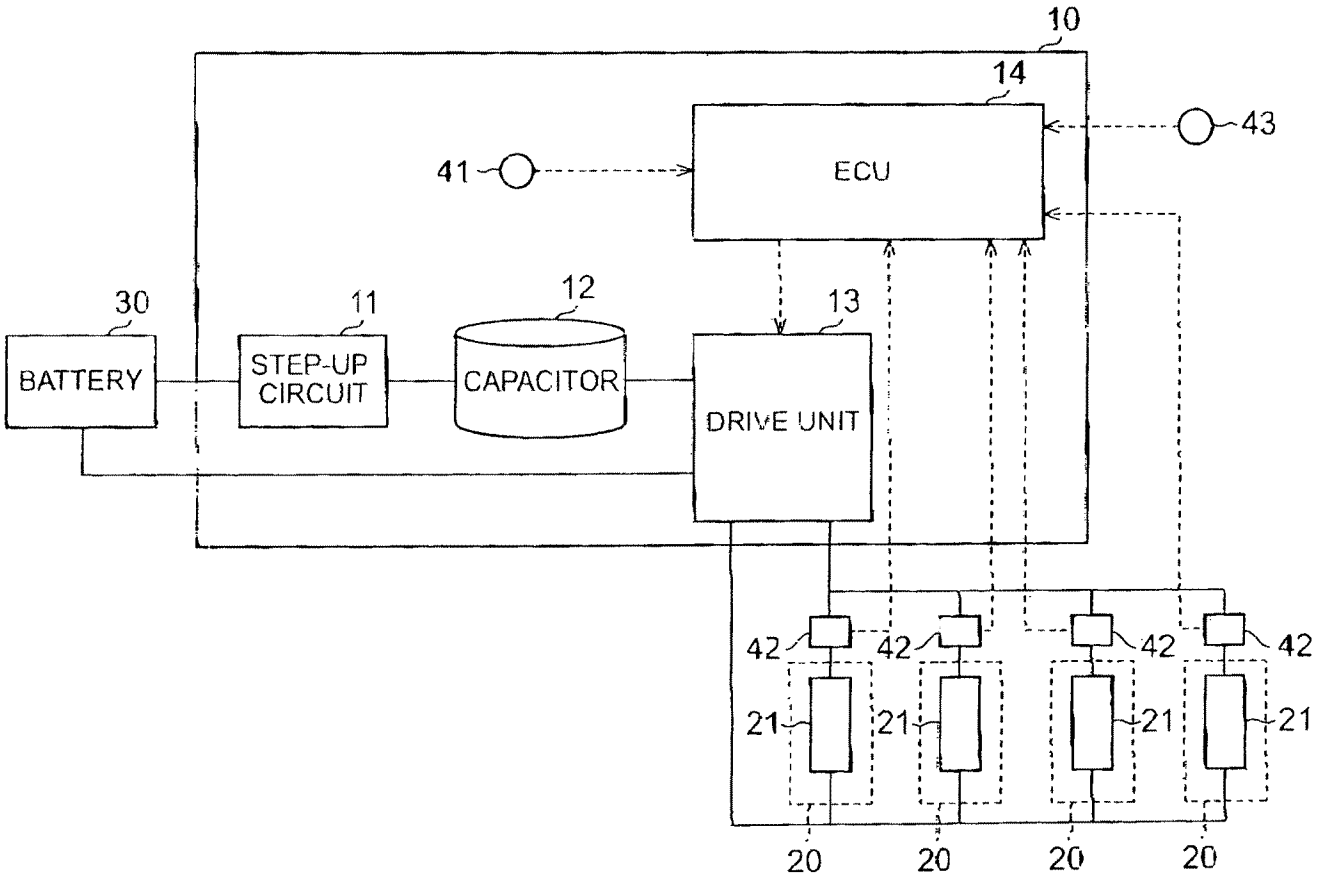
FIG. 1 is a schematic view that shows the schematic configuration of a drive system according to an embodiment and a plurality of fuel injection valves that are controlled by the drive system.

Hereinafter an embodiment of a drive system and drive method for fuel injection valves, which cause the fuel injection valves provided in an internal combustion engine to open or close, will be described with reference to FIG. 1 to FIG. 20. FIG. 1 shows the drive system 10 that executes the drive method according to the present embodiment and the plurality of (four) fuel injection valves 20 that are controlled by the drive system 10. Each of these fuel injection valves 20 is a direct-injection injection valve that directly injects fuel into a corresponding one of combustion chambers of the internal combustion engine.

As shown in FIG. 1, the drive system 10 includes a step-up circuit 11, a capacitor 12 and a drive unit 13. The step-up circuit 11 steps up the voltage of a battery 30. The battery 30 is provided in a vehicle. The capacitor 12 is charged with the voltage stepped up by the step-up circuit 11. The drive unit 13 serves as a drive control unit. The drive unit 13 is configured to drive the fuel injection valves 20 by selectively using one of the capacitor 12 and the battery 30 as a power supply depending on an occasion under control of an electronic control unit (hereinafter, referred to as "ECU") 14 having a control function and a learning function. The drive unit 13 corresponds to a "drive control circuitry".

The ECU 14 includes a microcomputer that is constructed of a CPU, a ROM, a RAM, and the like. Various control programs that are executed by the CPU, and the like, are prestored in the ROM. Information that is updated as needed is stored in the RAM.

Various detection systems, such as a voltage sensor 41, current detection circuits 42 and a fuel pressure sensor 43, are electrically connected to the ECU 14. The voltage sensor 41 is configured to detect a capacitor voltage Vc that is the voltage of the capacitor 12. Each of the current detection circuits 42 is configured to detect an exciting current Iinj flowing through a solenoid 21 of a corresponding one of the fuel injection valves 20. The current detection circuits 42 are provided in correspondence with the fuel injection valves 20. The fuel pressure sensor 43 is configured to detect a fuel pressure in a delivery pipe provided in a fuel supply system to the fuel injection valves 20. The drive system 10 including the ECU 14 is configured to control each fuel injection valve 20 on the basis of information that is detected by the various detection systems.

Figure 2:
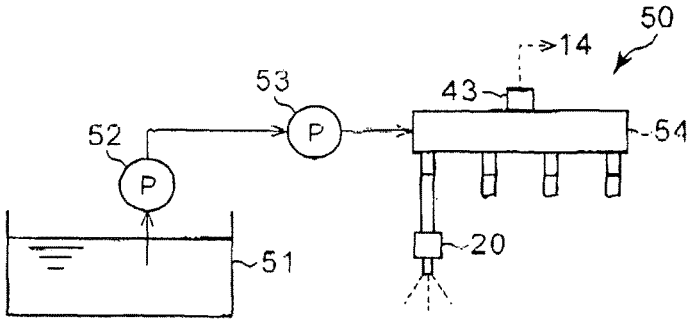
FIG. 2 is a schematic view that shows the schematic configuration of a fuel supply system that supplies fuel to the fuel injection valves.

Next, the fuel supply system 50 that supplies fuel to the fuel injection valves 20 will be described with reference to FIG. 2. As shown in FIG. 2, the fuel supply system 50 includes a low-pressure fuel pump 52, a high-pressure fuel pump 53 and the delivery pipe 54. The low-pressure fuel pump 52 draws fuel from a fuel tank 51 in which fuel is stored. The high-pressure fuel pump 53 pressurizes and discharges fuel discharged from the low-pressure fuel pump 52. High-pressure fuel discharged from the high-pressure fuel pump 53 is stored in the delivery pipe 54. Fuel in the delivery pipe 54 is supplied to the fuel injection valves 20.

Figure 3:
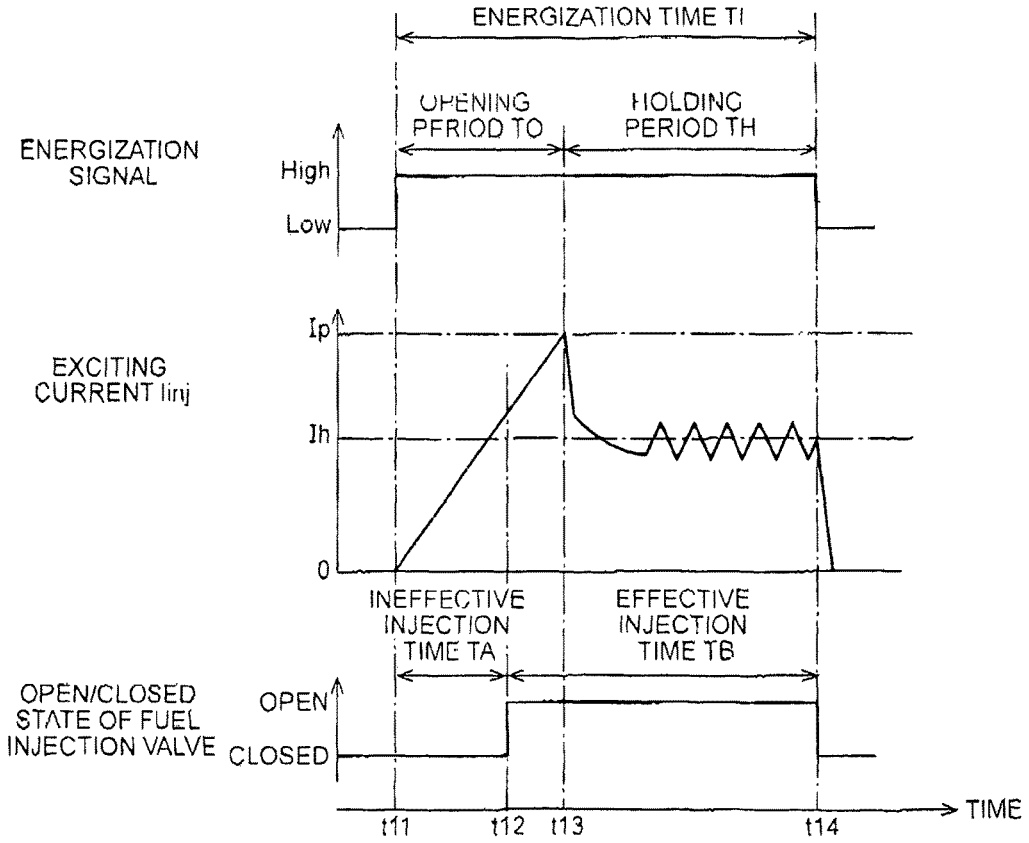
FIG. 3 is an example of a timing chart in the case where fuel is injected from one of the fuel injection valves.

Next, a mode in which each of the fuel injection valves 20 is energized will be described with reference to FIG. 3. The top row of FIG. 3 shows changes in the level of an energization signal that is output from the ECU to the drive unit. The middle row of FIG. 3 shows changes in exciting current that flows through a solenoid 21 of one of the fuel injection valves 20. The bottom row of FIG. 3 shows changes in an valve-open/closed state of the one of the fuel injection valves 20. When the level of an energization signal that is output from the ECU 14 to the drive unit 13 changes from "Low" to "High", an exciting current Iinj starts flowing through the solenoid 21 of the corresponding fuel injection valve 20. That is, a period from first timing t11 at which the level of the energization signal changes from "Low" to "High" to fourth timing t14 at which the level of the energization signal changes from "High" to "Low" is an energization time TI during which the fuel injection valve 20 is energized.

At the first timing t11 that is the energization start timing at which energization of the fuel injection valve 20 is started, the fuel injection valve 20 is closed. Here, in order to open the fuel injection valve 20, the fuel injection valve 20 is energized with the use of the capacitor 12 as a power supply. The capacitor 12 is able to apply a voltage higher than that of the battery 30. In this case, because the exciting current Iinj flowing through the solenoid 21 gradually increases, an electromagnetic force that is generated at the solenoid 21 also gradually increases. At second timing t12 in the middle of an increase in the exciting current Iinj, the fuel injection valve 20 opens, and fuel is injected from the fuel injection valve 20.

A time from the first timing t11 to the second timing t12 is regarded as an ineffective injection time TA during which fuel is not injected yet from the fuel injection valve 20 although energization of the fuel injection valve 20 is started. A time from the second timing t12 to the fourth timing t14 at which energization of the fuel injection valve 20 ends is regarded as an effective injection time TB during which fuel is actually injected from the fuel injection valve 20.

When the exciting current Iinj flowing through the solenoid 21 reaches a peak current value Ip at third timing t13 after the second timing t12, an opening period TO for opening the fuel injection valve 20 ends, and a holding period TH for holding the valve-open state of the fuel injection valve 20 starts. The peak current value Ip is set as a current value for reliably opening the fuel injection valve. As a result, the power supply is changed by the drive unit 13 from the capacitor 12 to the battery 30, and the voltage that is applied to the solenoid 21 of the fuel injection valve 20 decreases, so the exciting current Iinj steeply decreases. The rate of decrease in the exciting current Iinj at this time is remarkably higher than the rate of increase at the time when the exciting current Iinj increases toward the peak current value Ip. That is, when the exciting current Iinj decreases from the peak current value Ip, a variation in the exciting current Iinj is steep.

The exciting current Iinj that decreases from the peak current value Ip is adjusted near a predetermined holding current value Ih such that an electromagnetic force that is able to hold the valve-open state of the fuel injection valve 20 is generated from the solenoid 21. After that, when the energization signal changes from "High" to "Low" at the fourth timing t14, energization of the fuel injection valve 20 is ended, and the fuel injection valve 20 closes.

The energization time TI is determined on the basis of a required injection amount that is set for single fuel injection, so the energization time TI is reduced as the required injection amount reduces. That is, when the required injection amount is small, energization of the fuel injection valve 20 may be ended in the opening period TO in which the fuel injection valve 20 is energized from the capacitor 12.

Incidentally, in the drive system 10 and the drive method according to the present embodiment, fuel is sequentially injected from the fuel injection valves 20. At this time, in the relationship between the last fuel injection valve that starts fuel injection first and the current fuel injection valve that starts fuel injection subsequently among the fuel injection valves that sequentially inject fuel, an energization start interval TRPW may become short depending on the operation mode of the internal combustion engine. The energization start interval TRPW is a time interval between the energization start timing of the last fuel injection valve that starts fuel injection first and the energization start timing of the current fuel injection valve that starts fuel injection subsequently to the last fuel injection valve. That is, at the time of causing the plurality of fuel injection valves to sequentially inject fuel, the energization start interval TRPW may become short. The energization start interval TRPW is a time interval between the energization start timing of the last fuel injection valve of which energization is started immediately before energization of the current fuel injection valve that starts fuel injection from this time on is started and the energization start timing of the current fuel injection valve that starts fuel injection from this time on.

In the following description, the energization start timing of the last fuel injection valve 20 that has started fuel injection immediately before the fuel injection valve 20 that injects fuel from this time on, that is, the fuel injection valve 20 that starts fuel injection first, among the fuel injection valves 20 that sequentially inject fuel, is termed "first energization start timing". The energization start timing of the current fuel injection valve 20 that injects fuel from this time on, that is, the current fuel injection valve 20 that starts fuel injection subsequently to the last fuel injection valve, among the fuel injection valves 20 that sequentially inject fuel is termed "second energization start timing" The timing at which the exciting current Iinj flowing though the solenoid 21 of the fuel injection valve 20 of which energization is started from the first energization start timing reaches the peak current value Ip is termed "peak reach timing", and a time interval from the first energization start timing to the peak reach timing is termed "peak reaching time TRPK".

Figure 4:
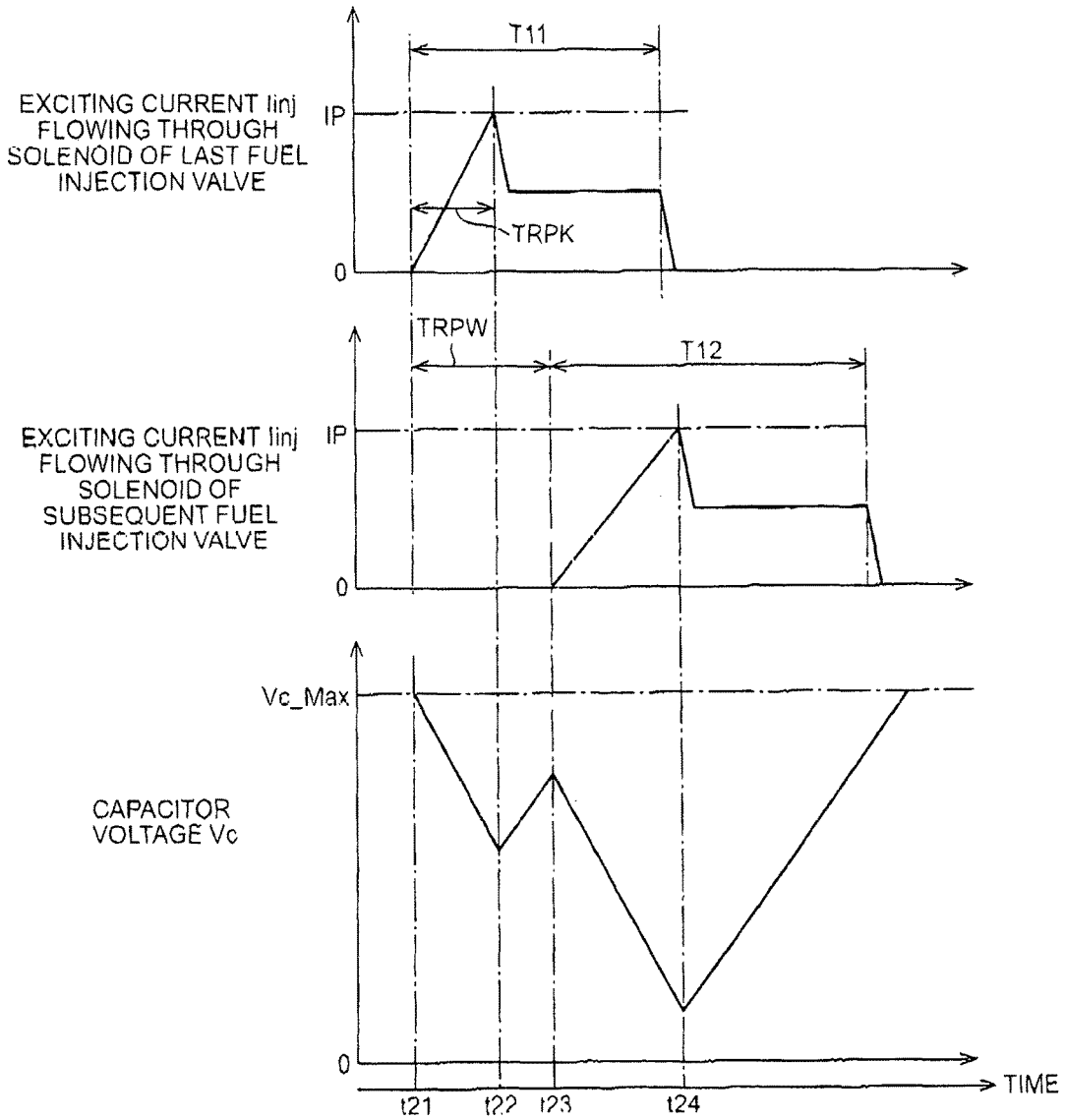
FIG. 4 is an example of a timing chart in the case where an energization start interval is longer than a peak reaching time.

Next, the case where the energization start interval TRPW is longer than the peak reaching time TRPK will be described with reference to FIG. 4. The top row of FIG. 4 shows changes in exciting current that flows through the solenoid 21 of the last fuel injection valve 20 of which energization is started first. The middle row shows changes in exciting current that flows through the solenoid 21 of the current fuel injection valve 20 of which energization is started subsequently. The bottom row shows changes in capacitor voltage. At the first timing t21 that is the first energization start timing, energization of the last fuel injection valve 20, which starts fuel injection first, from the capacitor 12 is started among the fuel injection valves 20 that sequentially inject fuel. As a result, the capacitor voltage Vc gradually decreases. At the second timing t22 that is the peak reach timing, the power supply that supplies electric power to the last fuel injection valve 20 is changed from the capacitor 12 to the battery 30. At the second timing t22, energization of the current fuel injection valve 20, which starts fuel injection subsequently to the last fuel injection valve 20, from the capacitor 12 is not started yet, so the capacitor voltage Vc is gradually recovered through charging from the battery 30. That is, the capacitor voltage Vc increases toward an upper limit voltage Vc_Max based on the capacitance of the capacitor 12 at that timing.

The capacitor 12 is charged by the battery 30 not only when energization of any one of the fuel injection valves 20 from the capacitor 12 is not carried out but also when energization of any one of the fuel injection valves 20 from the capacitor 12 is carried out. However, when any one of the fuel injection valves 20 is energized from the capacitor 12, the amount of electric charge that is discharged from the capacitor 12 to the fuel injection valve 20 is larger than the amount of electric charge that is supplied from the battery 30 to the capacitor 12. Therefore, when any one of the fuel injection valves 20 is energized from the capacitor 12, the capacitor voltage Vc decreases even when the capacitor 12 is charged by the battery 30.

At the third timing t23 in the middle of recovery of the capacitor voltage Vc, energization of the current fuel injection valve 20 from the capacitor 12 is started. That is, the third timing t23 becomes the second energization start timing. In this case, the capacitor 12 functions as the power supply that supplies electric power to the current fuel injection valve 20, so the capacitor voltage Vc gradually decreases from the third timing t23.

After that, when the exciting current Iinj flowing through the solenoid 21 of the current fuel injection valve 20 at the fourth timing t24 reaches the peak current value Ip, the power supply that supplies electric power to the current fuel injection valve 20 is changed from the capacitor 12 to the battery 30. Therefore, from the fourth timing t24, the capacitor voltage Vc gradually recovers toward the upper limit voltage Vc_Max through charging of the capacitor 12 by the battery 30.

At the first timing t21 that is the first energization start timing, the capacitor voltage Vc is the upper limit voltage Vc_Max based on the capacitance of the capacitor 12 at that timing; whereas, at the third timing t23 that is the second energization start timing, the capacitor voltage Vc is lower than the upper limit voltage Vc_Max. Therefore, when the required injection amount of each fuel injection valve 20 is equal, the rate of increase in the exciting current Iinj flowing through the solenoid 21 of the current fuel injection valve 20 tends to be lower than the rate of increase in the exciting current Iinj flowing through the solenoid 21 of the last fuel injection valve 20. That is, the ineffective injection time TA of the current fuel injection valve 20 is longer than the ineffective injection time TA of the last fuel injection valve 20. Thus, if the energization time TI2 of the current fuel injection valve 20 is set so as to be equal to the energization time TI1 of the last fuel injection valve 20 because the required injection amount of each fuel injection valve 20 is equal, the amount of fuel that is actually injected from the current fuel injection valve 20 may become smaller than the required injection amount. Therefore, when the required injection amount of each fuel injection valve 20 is equal, it is desirable to set the amount of fuel that is injected from the current fuel injection valve 20 to an amount appropriate to the required injection amount by extending the energization time TI2 of the current fuel injection valve 20 as compared to the energization time TI1 of the last fuel injection valve 20.

In contrast, the drive system 10 and the drive method according to the present embodiment calculate the timing at which energization of the current fuel injection valve 20 that starts fuel injection from this time on is started, that is, an estimated value Vc_Est of the capacitor voltage at the second energization start timing, at the time of setting the energization time TI of the current fuel injection valve 20. The energization time TI is extended as the calculated estimated value of the capacitor voltage Vc_Est decreases.

Figure 5:
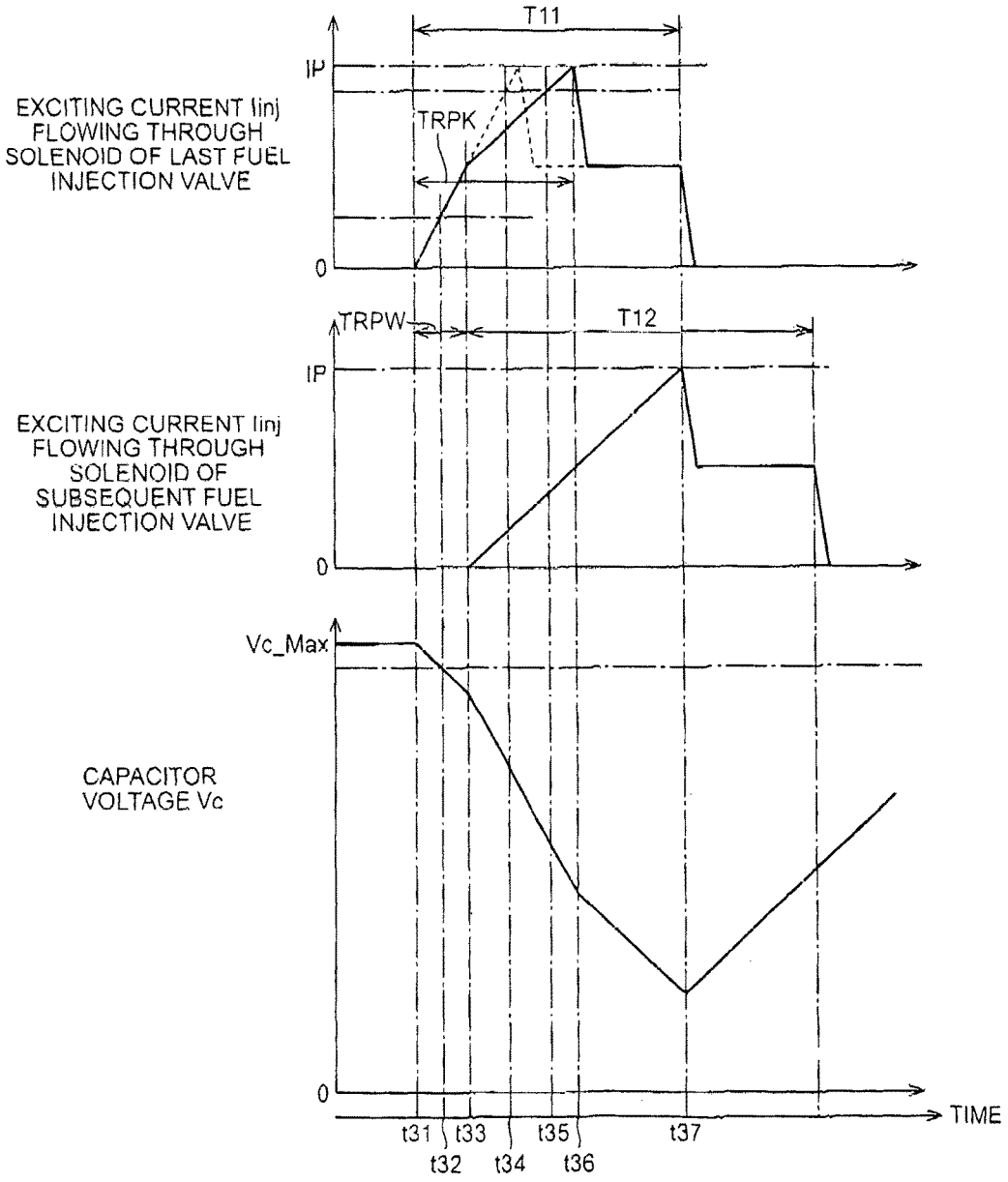
FIG. 5 is an example of a timing chart in the case where the energization start interval is shorter than the peak reaching time.

Next, the case where the energization start interval TRPW is shorter than the peak reaching time TRPK will be described with reference to FIG. 5. The top row of FIG. 5 shows changes in exciting current that flows through the solenoid 21 of the last fuel injection valve 20 of which energization is started first. The middle row shows changes in exciting current that flows through the solenoid 21 of the current fuel injection valve 20 of which energization is started subsequently. The bottom row shows changes in the capacitor voltage. Because energization of the last fuel injection valve 20 from the capacitor 12 is started at the first timing t31 that is the first energization start timing, the capacitor voltage Vc gradually decreases from the first timing t31. Energization of the current fuel injection valve 20 from the capacitor 12 is started at the third timing t33 in the middle of energization of the last fuel injection valve 20 from the capacitor 12. In this case, the third timing t33 becomes the second energization start timing. The capacitor 12 energizes only the last fuel injection valve 20 before the third timing t33; whereas the capacitor 12 also energizes the current fuel injection valve 20 in addition to the last fuel injection valve 20 from the third timing t33. Therefore, from the third timing t33, the rate of decrease in the capacitor voltage Vc increases by the amount of increase in the number of the fuel injection valves 20 that are driven by using the capacitor 12 as the power supply in comparison with that before the third timing t33.

In addition, the current fuel injection valve 20 is also energized from the capacitor 12, so the rate of increase in the exciting current Iinj flowing through the solenoid 21 of the last fuel injection valve 20 decreases as compared to that before the third timing t33. As a result, the timing at which the exciting current Iinj flowing through the solenoid 21 of the last fuel injection valve 20 reaches the peak current value Ip delays as compared to that in the case where the current fuel injection valve 20 is not energized from the capacitor 12 (state indicated by the dashed line in the top row of FIG. 5) in the middle of energization of the last fuel injection valve 20 from the capacitor 12.

When the exciting current Iinj flowing through the solenoid 21 of the last fuel injection valve 20 reaches the peak current value Ip at sixth timing t36, energization of the last fuel injection valve 20 from the capacitor 12 is ended. That is, the peak reach timing becomes the sixth timing t36. From the sixth timing t36, the fuel injection valve 20 that is driven by using the capacitor 12 as the power supply is only the current fuel injection valve 20. Therefore, the rate of decrease in the capacitor voltage Vc from the sixth timing t36 is lower than the rate of decrease in the capacitor voltage Vc between the third timing t33 and the sixth timing t36. After that, when the exciting current Iinj flowing through the solenoid 21 of the current fuel injection valve 20 at seventh timing t37 reaches the peak current value Ip, energization of the current fuel injection valve 20 from the capacitor 12 is ended. As a result, the capacitor voltage Vc is gradually recovered toward the upper limit voltage Vc_Max through charging of the battery 30.

Incidentally, as shown in FIG. 5, when energization of the current fuel injection valve 20 from the capacitor 12 is started in the middle of energization of the last fuel injection valve 20 from the capacitor 12, the last fuel injection valve 20 may be not opened yet at the second energization start timing when the fuel pressure in the delivery pipe 54 is high. For example, the open timing of each fuel injection valve 20 tends to be later as the fuel pressure in the delivery pipe 54 that supplies fuel to the fuel injection valve 20 increases. Therefore, when the fuel pressure in the delivery pipe 54 is high, the open timing of the last fuel injection valve 20 may delay and energization of the current fuel injection valve 20 may be started before the last fuel injection valve 20 opens.

With the start of energization of the current fuel injection valve 20, the rate of increase in the exciting current Iinj flowing through the solenoid 21 of the last fuel injection valve 20 decreases from the third timing t33. Therefore, when the last fuel injection valve 20 is not opened yet at the third timing t33 that is the second energization start timing, the open timing of the last fuel injection valve 20 delays as a result of the start of energization of the current fuel injection valve 20.

For example, when the current fuel injection valve 20 from the capacitor 12 is not energized (state indicated by the dashed line in the top row of FIG. 5) in the middle of energization of the last fuel injection valve 20 from the capacitor 12, the open timing of the last fuel injection valve 20 is the fourth timing t34. In contrast, when energization of the current fuel injection valve 20 is started at the third timing t33, the open timing of the last fuel injection valve 20 is the fifth timing t35 after the fourth timing t34. That is, the ineffective injection time TA of the last fuel injection valve 20 extends.

Therefore, in order to suppress a deviation between the actual injection amount of fuel from the last fuel injection valve 20 and the required injection amount, when the last fuel injection valve 20 is not opened yet at the second energization start timing at which energization of the current fuel injection valve 20 from the capacitor 12 is started, it is desirable to execute a correction process for extending the energization time TI1 of the last fuel injection valve 20.

When the last fuel injection valve 20 is already opened before the third timing t33 that is the second energization start timing, the open timing of the last fuel injection valve 20 does not delay irrespective of the start of energization of the current fuel injection valve 20 from the capacitor 12, so such a correction process is not required.

Next, a processing routine that is executed by the ECU 14 at the time of calculating the energization time TI of each fuel injection valve 20 will be described with reference to the flowchart shown in FIG. 6. The processing routine is executed at the time when energization of each fuel injection valve 20 from the capacitor 12 is started, that is, at the energization start timing. As in the case of the above description, among the plurality of fuel injection valves 20, the fuel injection valve that starts fuel injection from this time on is termed the current fuel injection valve 20, and the fuel injection valve of which energization is started immediately before the start of energization of the current fuel injection valve 20 is termed the last fuel injection valve 20.

Figure 6:
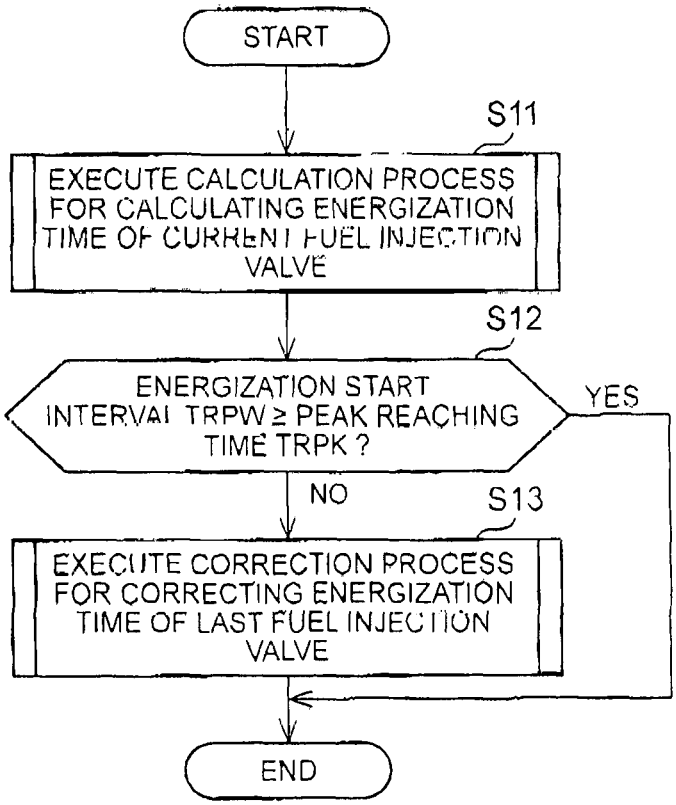
FIG. 6 is a flowchart that illustrates a processing routine that is executed at the time when fuel is injected from one of the fuel injection valves in a control device for the drive system according to the embodiment.

As shown in FIG. 6, in the processing routine, the ECU 14 executes the calculation process for calculating the energization time TI of the current fuel injection valve 20 (step S11). An example of the calculation process for calculating the energization time TI of the current fuel injection valve 20 will be described later with reference to FIG. 7. Subsequently, the ECU 14 determines whether the energization start interval TRPW is shorter than the peak reaching time TRPK (step S12). The energization start interval TRPW in this step S12 is a time interval between the first energization start timing and the second energization start timing. The first energization start timing is the energization start timing of the last fuel injection valve 20. The second energization start timing is the energization start timing of the current fuel injection valve 20. The peak reaching time TRPK is an estimated value of a time interval between the first energization start timing and the peak reach timing at which the exciting current Iinj flowing through the solenoid 21 of the last fuel injection valve 20 reaches the peak current value Ip.

When the energization start interval TRPW is longer than or equal to the peak reaching time TRPK, energization of the last fuel injection valve 20 from the capacitor 12 has been already ended at the second energization start timing that is the execution timing of the processing routine, so it may be determined that the energization time TI of the last fuel injection valve 20 does not need to be corrected. On the other hand, when the energization start interval TRPW is shorter than the peak reaching time TRPK, the last fuel injection valve 20 is still being energized from the capacitor 12 at the second energization start timing that is the execution timing of the processing routine. In addition, depending on the value of the fuel pressure Pa in the delivery pipe 54 or the length of the energization start interval TRPW, the last fuel injection valve 20 may not be opened yet. In this case, there is a concern that the opening of the last fuel injection valve 20 delays because of the start of energization of the current fuel injection valve 20 from the capacitor 12 at the second energization start timing, so there occurs a necessity to correct the energization time TI of the last fuel injection valve 20.

Therefore, when the energization start interval TRPW is longer than or equal to the peak reaching time TRPK (YES in step S12), the ECU 14 ends the processing routine without correcting the energization time TI of the last fuel injection valve 20. On the other hand, when the energization start interval TRPW is shorter than the peak reaching time TRPK (NO in step S12), the ECU 14 executes a correction process for correcting the energization time TI of the last fuel injection valve 20 (step S13), and, after that, ends the processing routine. The correction process for correcting the energization time of the last fuel injection valve 20 will be described later with reference to FIG. 8.

Figure 10:
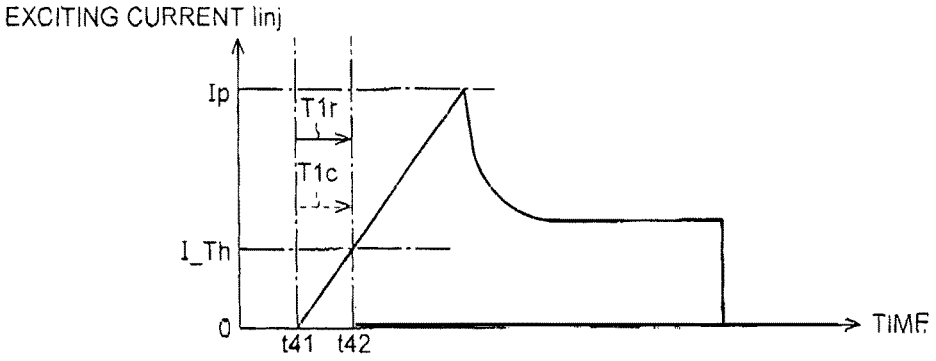
FIG. 10 is a timing chart that shows changes of exciting current flowing through a solenoid in the case where fuel is injected from one of the fuel injection valves.

Next, the routine of the calculation process for calculating the energization time TI of the current fuel injection valve 20 in step S11 will be described with reference to the flowchart shown in FIG. 7, the timing chart shown in FIG. 10 and the maps shown in FIG. 11 to FIG. 18.

Figure 7:
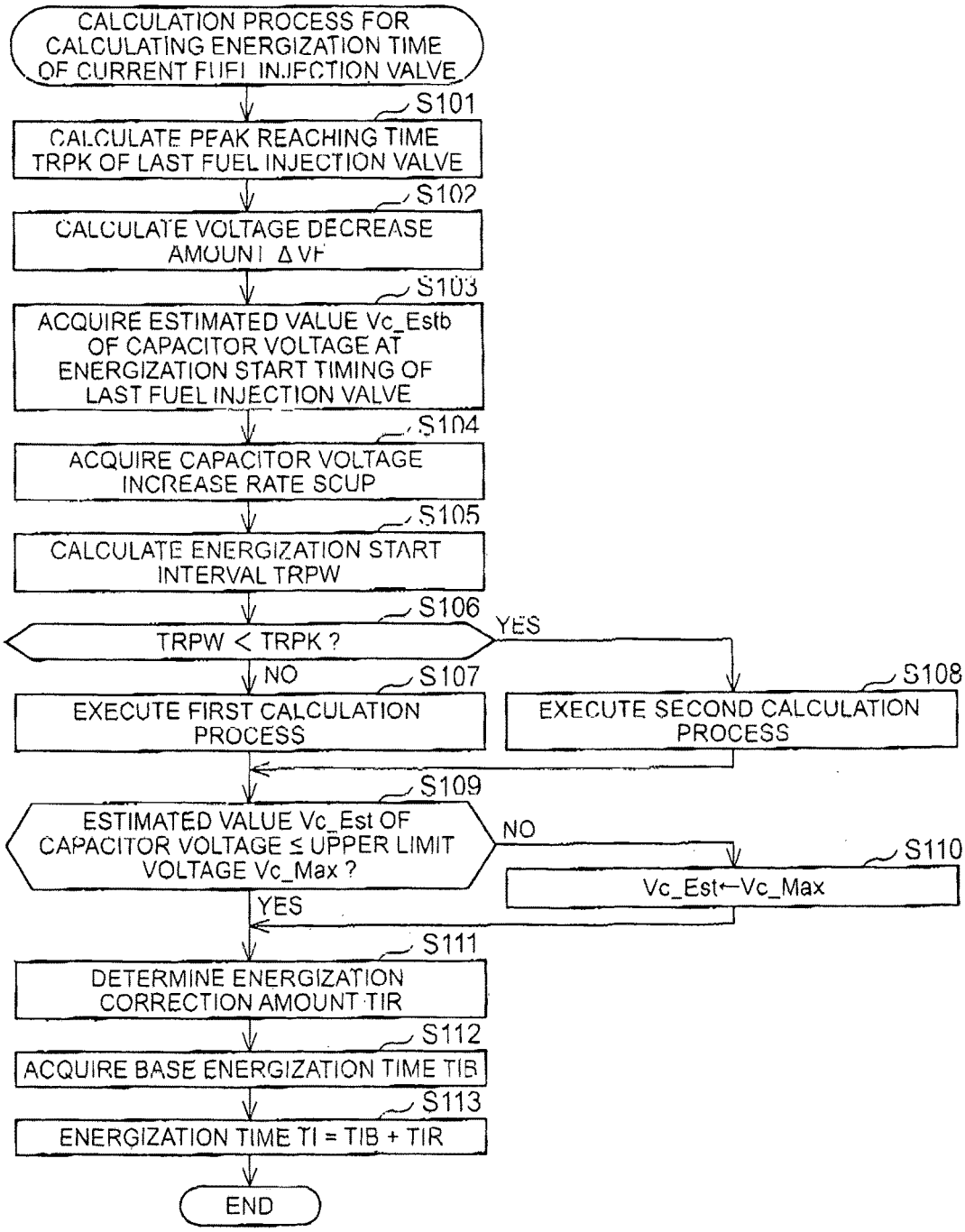
FIG. 7 is a flowchart that illustrates a processing routine that is executed in order to calculate an energization time of a current one of the fuel injection valves in the control device.

As shown in FIG. 7, in the processing routine, the ECU 14 calculates the peak reaching time TRPK of the last fuel injection valve 20 (step S101). The peak reaching time TRPK that is calculated in step S101 is an estimated value of a time interval from the energization start timing of the last fuel injection valve 20 to the timing at which the exciting current Iinj flowing through the solenoid 21 of the last fuel injection valve 20 reaches the peak current value Ip. The peak reaching time TRPK is allowed to be estimated on the basis of the rate of increase in the exciting current Iinj at the time when the exciting current Iinj flowing through the solenoid 21 increases toward the peak current value Ip and the magnitude of the peak current value Ip set for fuel injection from the last fuel injection valve 20. That is, the ECU 14 calculates a reaching time base value TRPK_B based on the rate of increase in the exciting current Iinj and a first peak correction amount TRPK_R based on the peak current value Ip, and calculates the peak reaching time TRPK by adding the calculated reaching time base value TRPK_B and the first peak correction amount TRPK_R together.

Here, a method of calculating the reaching time base value TRPK_B will be described. As shown in FIG. 10, the ECU 14 measures a rising detection time T1*r* that is a time from the energization start timing t41 at which energization of the fuel injection valve 20 is started to rising detection timing t42 at which the exciting current Iinj exceeds a prescribed current value I_Th smaller than the peak current value Ip. The rising detection time T1*r* tends to extend as the rate of increase in the exciting current Iinj decreases, and may be regarded as a value that corresponds to the rate of increase in the exciting current Iinj. The prescribed current value I_Th is set to such a small value that the exciting current Iinj is able to definitely exceed the prescribed current value I_Th even when the required injection amount set for the fuel injection valve 20 is a minimum injection amount of the fuel injection valve 20.

Incidentally, the rising detection time T1*r* that is a measured value contains variations in current value that is detected by the corresponding current detection circuit 42. Therefore, if the reaching time base value TRPK_B is calculated on the basis of the rising detection time T1*r*, it is difficult to be regarded that the calculation accuracy is high. Therefore, the ECU 14 calculates a rising calculation time T1*c* that is a calculated value of a time from the energization start timing t41 to the rising detection timing t42.

For example, the ECU 14 calculates in advance a variation ratio learning value Rc based on the characteristic of each current detection circuit 42 that detects the exciting current Iinj flowing through the solenoid 21 of the corresponding fuel injection valve 20 that is energized from the capacitor 12. The ECU 14 measures the rising detection time T1*r*, loads the variation ratio learning value Rc, corresponding to the current detection circuit 42 of the current fuel injection valve 20, from the memory, and calculates the rising calculation time Tlc by multiplying the rising detection time T1*r* by the variation ratio learning value Rc. The rising calculation time T1*c* is a value that is calculated by reflecting the variation ratio learning value and from which variations in current value that is detected by the current detection circuit 42 are removed as much as possible, so the rising calculation time T1*c* is a value that corresponds with the rate of increase in the exciting current Iinj as compared to the rising detection time T1*r*. The ECU 14 calculates the reaching time base value TRPK_B based on the rising calculation time T1*c* with the use of the map shown in FIG. 11. By executing the above calculation process using the rising calculation time T1*c*, it is possible to increase the calculation accuracy of the reaching time base value TRPK_B as compared to that in the case where the calculation process using the rising detection time T1*r* is executed.

Figure 11:
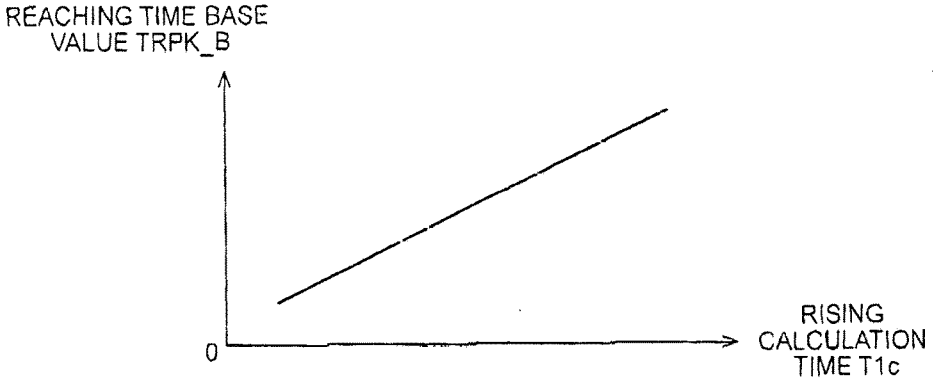
FIG. 11 is a map that shows the correlation between a rising calculation time and a reaching time base value.

FIG. 11 shows the correlation between the rising calculation time Tlc and the reaching time base value TRPK_B. As shown in FIG. 11, the reaching time base value TRPK_B increases as the rising calculation time T1*c* extends. Thus, by calculating the reaching time base value TRPK_B based on the rising calculation time T1*c* with the use of the map shown in FIG. 11, the reaching time base value TRPK_B increases as the rate of increase in the exciting current Iinj decreases and as the rising calculation time T1*c* extends.

Next, a method of calculating the first peak correction amount TRPK_R will be described. When the rate of increase in the exciting current Iinj that increases toward the peak current value Ip from the energization start timing is equal, the peak reaching time TRPK tends to extend as the peak current value Ip increases. The ECU 14 calculates the first peak correction amount TRPK_R based on the set peak current value Ip with the use of the map shown in FIG. 12.

Figure 12:
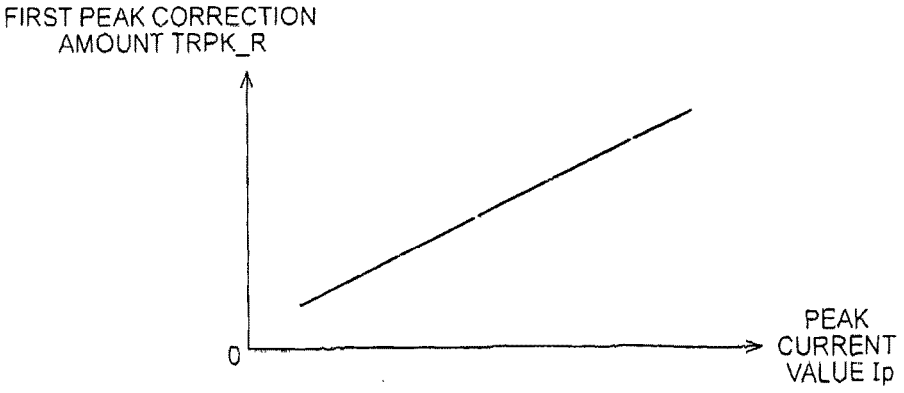
FIG. 12 is a map that shows the correlation between a peak current value and a first peak correction amount.

FIG. 12 shows the correlation between the peak current value Ip and the first peak correction amount TRPK_R. As shown in FIG. 12, the first peak correction amount TRPK_R increases as the peak current value Ip increases.

Referring back to FIG. 7, the ECU 14, which has calculated the peak reaching time TRPK in step S101, calculates a voltage decrease amount ΔVF from the first energization start timing to the peak reach timing (step S102). The voltage decrease amount ΔVF is a value corresponding to the amount of electric charge that is supplied from the capacitor 12 to the solenoid 21 of the last fuel injection valve 20 in a period from the first energization start timing to the peak reach timing. The voltage decrease amount ΔVF is allowed to be estimated on the basis of the peak current value Ip set for fuel injection of the last fuel injection valve 20, the peak reaching time TRPK of the last fuel injection valve 20 and a capacitor capacitance CC at the present timing. The ECU 14 calculates a second peak correction amount ΔVF_RI based on the peak current value Ip set at the time of fuel injection from the last fuel injection valve 20, a time interval correction amount ΔVF_RP based on the peak reaching time TRPK and a first capacitance correction amount ΔVF_RC based on the capacitor capacitance CC. The ECU 14 calculates the voltage decrease amount ΔVF by adding the second peak correction amount ΔVF_RI, the time interval correction amount ΔVF_RP and the first capacitance correction amount ΔVF_RC to a base value ΔVF_B that is set in advance.

Here, a method of calculating the second peak correction amount ΔVF_RI will be described. As the peak current value Ip increases, a large current flows through the solenoid 21 of the fuel injection valve 20. Therefore, it is estimated that the amount of electric charge that is supplied from the capacitor 12 to the solenoid 21 of the last fuel injection valve 20 in a period from the first energization start timing to the peak reach timing is large. Therefore, the voltage decrease amount ΔVF tends to increase as the peak current value Ip increases. The ECU 14 calculates the second peak correction amount ΔVF_RI based on the peak current value Ip with the use of the map shown in FIG. 13.

Figure 13:
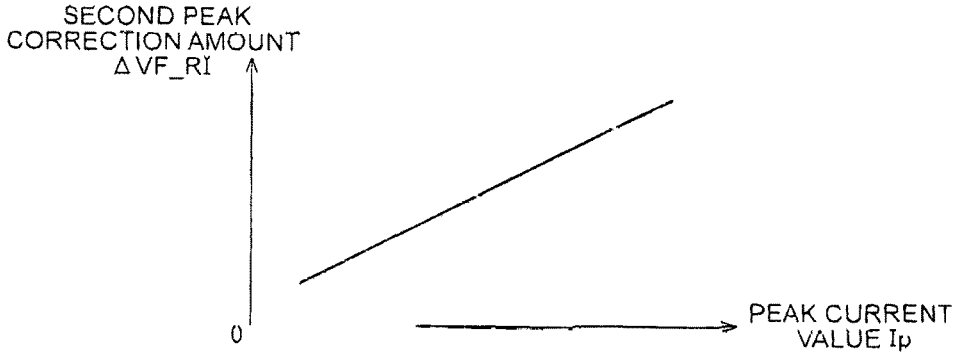
FIG. 13 is a map that shows the correlation between a peak current value and a second peak correction amount.

FIG. 13 shows the correlation between the peak current value Ip and the second peak correction amount ΔVF_RI. As shown in FIG. 13, the second peak correction amount ΔVF_RI increases as the peak current value Ip increases.

A method of calculating the time interval correction amount ΔVF_RP will be described. As the peak reaching time TRPK extends, a time during which electric power is continuously supplied from the capacitor 12 to the fuel injection valve 20 extends. This indicates that the time during which electric charge is supplied from the capacitor 12 to the solenoid 21 of the fuel injection valve 20 is long. As the time during which electric charge is supplied in this way extends and as the amount of electric charge that is discharged from the capacitor 12 to the fuel injection valve 20 increases, the capacitor voltage Vc tends to decrease. Therefore, the voltage decrease amount ΔVF tends to increase as the peak reaching time TRPK extends. The ECU 14 calculates the time interval correction amount ΔVF_RP based on the peak reaching time TRPK with the use of the map shown in FIG. 14.

Figure 14:
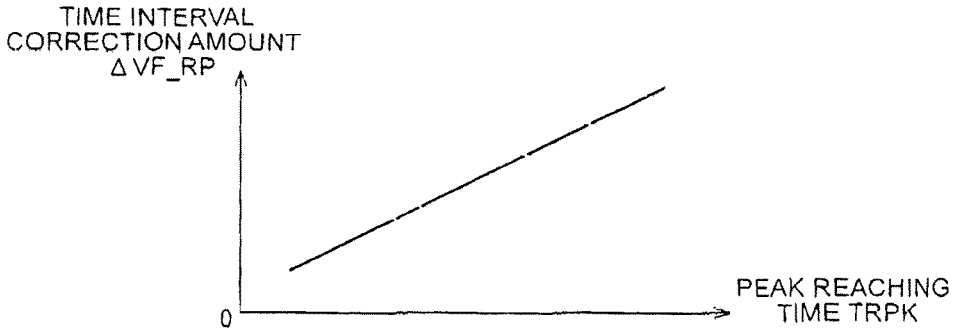
FIG. 14 is a map that shows the correlation between a peak reaching time and a time interval correction amount.

FIG. 14 shows the correlation between the peak reaching time TRPK and the time interval correction amount ΔVF_RP. As shown in FIG. 14, the time interval correction amount ΔVF_RP increases as the peak reaching time TRPK extends.

A method of calculating the first capacitance correction amount ΔVF_RC will be described. When electric charge in the same amount is supplied from the capacitor 12 to the solenoid 21 of the fuel injection valve 20, the capacitor voltage Vc tends to decrease as the capacitor capacitance CC reduces. Therefore, the ECU 14 calculates the first capacitance correction amount ΔVF_RC on the basis of the capacitor capacitance CC with the use of the map shown in FIG. 15.

The capacitor capacitance CC varies with variations in manufacturing of the capacitor 12, aged degradation of the capacitor 12, and the like. Therefore, the capacitor capacitance CC is desirably learned on the basis of a variation mode of the capacitor voltage Vc during engine operation, or the like. A method of learning the capacitor capacitance CC will be described later with reference to FIG. 9 and FIG. 20. At the time of calculating the first capacitance correction amount ΔVF_RC, a learning value of the capacitor capacitance, learned by the learning method, is employed as the capacitor capacitance CC.

Figure 15:
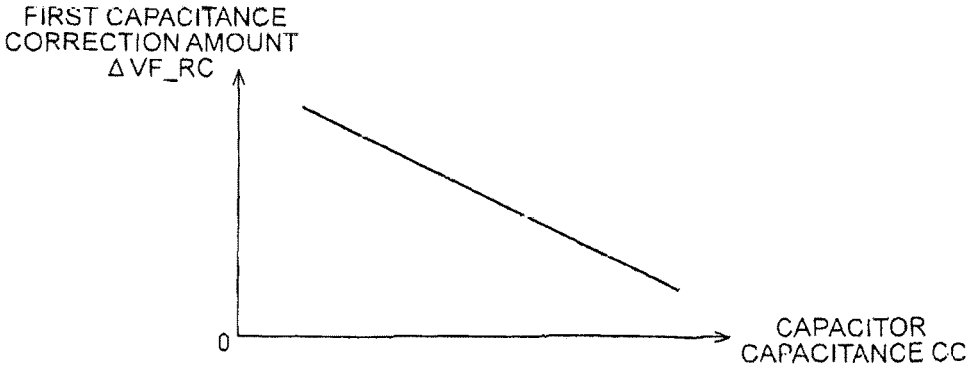
FIG. 15 is a map that shows the correlation between a capacitor capacitance and a first capacitance correction amount.

FIG. 15 shows the correlation between the capacitor capacitance CC and the first capacitance correction amount ΔVF_RC. As shown in FIG. 15, the first capacitance correction amount ΔVF_RC increases as the capacitor capacitance CC reduces.

Referring back to FIG. 7, the ECU 14, which has calculated the voltage decrease amount ΔVF in step S102, loads an estimated value Vc_Estb of the capacitor voltage at the first energization start timing from the memory (step S103). The first energization start timing is the energization start timing of the last fuel injection valve 20. Subsequently, the ECU 14 loads a capacitor voltage increase rate SCUP from the memory (step S104). The capacitor voltage increase rate SCUP is an estimated value of the rate of recovery of the capacitor voltage Vc at the time when the capacitor voltage Vc is recovered toward the upper limit voltage Vc_Max.

Here, a method of calculating the capacitor voltage increase rate SCUP will be described. In terms of the characteristic of the capacitor 12, when the capacitor voltage Vc is recovered through charging of the capacitor 12 by the battery 30, the capacitor voltage Vc more quickly recovers, that is, the capacitor voltage increase rate SCUP tends to increase, as the capacitor capacitance CC reduces. Because the voltage that is applied to the capacitor 12 increases as a battery voltage VB that is the voltage of the battery 30 increases, the capacitor voltage increase rate SCUP tends to increase as the battery voltage VB increases. That is, the capacitor voltage increase rate SCUP is allowed to be estimated on the basis of the capacitor capacitance CC and the battery voltage VB.

Figure 16:
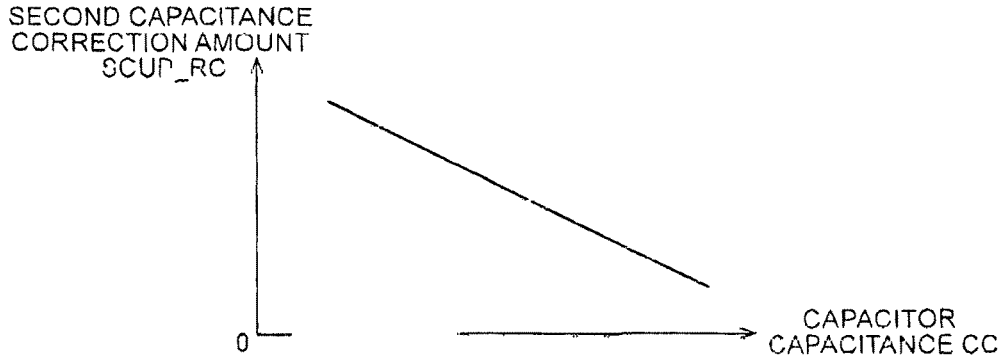
FIG. 16 is a map that shows the correlation between a capacitor capacitance and a second capacitance correction amount.
Figure 17:
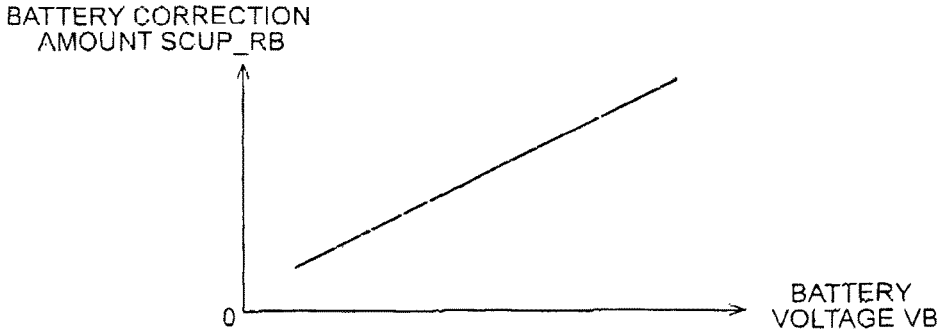
FIG. 17 is a map that shows the correlation between a battery voltage and a battery correction amount.

Therefore, the ECU 14 calculates a second capacitance correction amount SCUP_RC based on the capacitor capacitance CC with the use of the map shown in FIG. 16, and calculates a battery correction amount SCUP_RB based on the battery voltage VB with the use of the map shown in FIG. 17. The ECU 14 calculates the capacitor voltage increase rate SCUP by adding the second capacitance correction amount SCUP_RC and the battery correction amount SCUP_RB to a preset base value SCUP_B.

FIG. 16 shows the correlation between the capacitor capacitance CC and the second capacitance correction amount SCUP_RC. As shown in FIG. 16, the second capacitance correction amount SCUP_RC increases as the capacitor capacitance CC reduces.

FIG. 17 shows the correlation between the battery voltage VB and the battery correction amount SCUP_RB. As shown in FIG. 17, the battery correction amount SCUP_RB increases as the battery voltage VB increases.

Referring back to FIG. 7, the ECU 14, which has acquired the capacitor voltage increase rate SCUP in step S104, calculates the energization start interval TRPW (step S105). The energization start interval TRPW is a time interval between the energization start timing of the last fuel injection valve 20 and the energization start timing of the current fuel injection valve 20, that is, a time interval between the first energization start timing and the second energization start timing. The ECU 14 determines whether the energization start interval TRPW is shorter than the peak reaching time TRPK calculated in step S101 (step S106). As described above, when the energization start interval TRPW is shorter than the peak reaching time TRPK, energization of the current fuel injection valve 20 from the capacitor 12 is started while the last fuel injection valve 20 from the capacitor 12 is being energized. On the other hand, when the energization start interval TRPW is longer than or equal to the peak reaching time TRPK, energization of the last fuel injection valve 20 from the capacitor 12 is already ended at the timing at which energization of the current fuel injection valve 20 from the capacitor 12 is started, that is, at the second energization start timing. Therefore, it is desirable to change the method of calculating the estimated value Vc_Est of the capacitor voltage on the basis of whether the energization start interval TRPW is shorter than the peak reaching time TRPK.

Therefore, when the energization start interval TRPW is longer than or equal to the peak reaching time TRPK (NO in step S106), the ECU 14 calculates the estimated value Vc_Est of the capacitor voltage through a first calculation process that uses the following relational expression (1) (step S107). That is, the estimated value Vc_Est of the capacitor voltage is calculated by substituting the voltage decrease amount ΔVF, the estimated value Vc_Estb of the capacitor voltage at the first energization start timing, the capacitor voltage increase rate SCUP and the energization start interval TRPW, calculated in step S102 to step S105, into the relational expression (1). In this case, the estimated value Vc_Est of the capacitor voltage increases as the energization start interval TRPW extends. The ECU 14 proceeds with the process to step S109 (described later).

$$Vc_Est = Vc_Estb - \Delta VF + (TRPW \times SCUP) \quad (1)$$

On the other hand, when the energization start interval TRPW is shorter than the peak reaching time TRPK (YES in step S106), the ECU 14 calculates the estimated value Vc_Est of the capacitor voltage through a second calculation process that uses the following relational expression (2) (step S108). That is, the estimated value Vc_Est of the capacitor voltage is calculated by substituting the peak reaching time TRPK, the voltage decrease amount ΔVF, the estimated value Vc_Estb of the capacitor voltage at the first energization start timing, the capacitor voltage increase rate SCUP and the energization start interval TRPW, calculated in step S101 to step S105, into the relational expression (2). In this case, the estimated value Vc_Est of the capacitor voltage increases as the energization start interval TRPW reduces. The ECU 14 proceeds with the process to the next step S109.

$$Vc_Est = Vc_Estb - (\Delta VF \times TRPW/TRPK) + (TRPW \times SCUP) \quad (2)$$

In step S109, the ECU 14 determines whether the calculated estimated value Vc_Est of the capacitor voltage is lower than or equal to the upper limit voltage Vc_Max that is allowed to be obtained from the capacitor capacitance CC. When the estimated value Vc_Est of the capacitor voltage is higher than the upper limit voltage Vc_Max (NO in step S109), the ECU 14 sets the upper limit voltage Vc_Max as the estimated value Vc_Est of the capacitor voltage (step S110), and proceeds with the process to the next step S111. On the other hand, when the estimated value Vc_Est of the capacitor voltage is lower than or equal to the upper limit voltage Vc_Max (YES in step S109), the ECU 14 proceeds with the process to the next step S111 without executing step S110.

In step S111, the ECU 14 determines an energization correction amount TIR to a value based on the estimated value Vc_Est of the capacitor voltage. When the estimated value Vc_Est of the capacitor voltage is low, it may be determined that the actual capacitor voltage Vc is low. When the capacitor voltage Vc is low in this way, the voltage that is applied to the solenoid 21 of the fuel injection valve 20 that carries out fuel injection is low, so the rate of increase in the exciting current Iinj flowing through the solenoid 21 tends to decrease. Therefore, it is desirable to increase the energization time TI of the current fuel injection valve 20 as the estimated value Vc_Est of the capacitor voltage at the second energization start timing decreases. Therefore, the ECU 14 calculates the energization correction amount TIR based on the estimated value Vc_Est of the capacitor voltage with the use of the map shown in FIG. 18.

Figure 18:
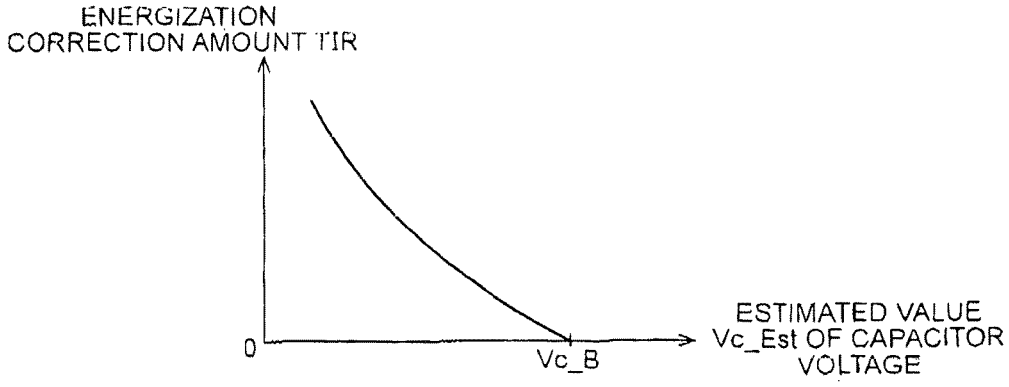
FIG. 18 is a map that shows the correlation between an estimated value of a capacitor voltage and an energization correction amount.

FIG. 18 shows the correlation between the estimated value Vc_Est of the capacitor voltage and the energization correction amount TIR. As shown in FIG. 18, the energization correction amount TIR increases as the estimated value Vc_Est of the capacitor voltage decreases. However, when the estimated value Vc_Est of the capacitor voltage is high to some extent, the length of the ineffective injection time TA is almost not influenced by the level of the capacitor voltage Vc. Therefore, in the map shown in FIG. 18, the energization correction amount TIR is "0 (zero)" in the case where the estimated value Vc_Est of the capacitor voltage is higher than or equal to a reference voltage value Vc_B.

Referring back to FIG. 7, the ECU 14, which has determined the energization correction amount TIR in step S111, acquires a base energization time TIB based on the required injection amount (step S112). The ECU 14 calculates the energization time TI of the current fuel injection valve 20 by adding the energization correction amount TIR, determined in step S111, to the base energization time TIB (step S113), and ends the processing routine.

Next, the routine of the correction process for correcting the energization time TI of the last fuel injection valve 20 in step S13 will be described with reference to the flowchart shown in FIG. 8 and the map shown in FIG. 19.

Figure 8:
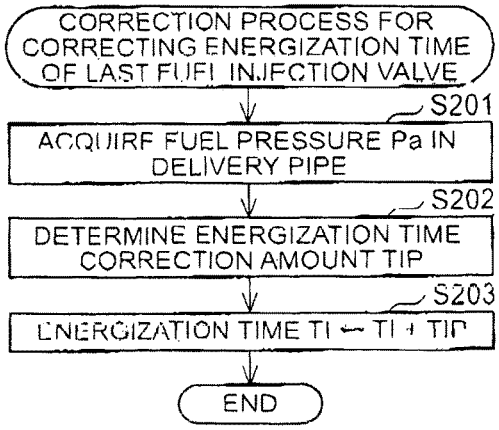
FIG. 8 is a flowchart that illustrates a processing routine that is executed in order to correct an energization time of a last one of the fuel injection valves in the control device.

As shown in FIG. 8, in the processing routine, the ECU 14 acquires the fuel pressure Pa in the delivery pipe 54 (step S201). For example, a sensor value of the fuel pressure, detected by the fuel pressure sensor 43, may be used as the fuel pressure Pa. Subsequently, the ECU 14 sets the energization time correction amount TIP to a value based on the fuel pressure Pa in the delivery pipe 54 and the energization start interval TRPW with the use of the map shown in FIG. 19 (step S202). The ECU 14 adds the energization time correction amount TIP to the energization time TI set for fuel injection of the last fuel injection valve 20, and executes the correction process for setting the sum (=TI+TIP) for the energization time TI (step S203), and, after that, ends the processing routine.

As described above, when the energization start interval TRPW is shorter than the peak reaching time TRPK, energization of the current fuel injection valve 20 from the capacitor 12 is started while the last fuel injection valve 20 is still being energized from the capacitor 12. At this time, as the fuel pressure Pa in the delivery pipe 54 decreases, there is a low possibility that the last fuel injection valve 20 has not opened yet at the second energization start timing that is the energization start timing of the current fuel injection valve 20. In other words, as the fuel pressure Pa increases, there is a high possibility that the last fuel injection valve 20 has not opened yet at the second energization start timing. Even when the fuel pressure Pa is about the same, the possibility that the last fuel injection valve 20 has not opened yet at the second energization start timing increases as the energization start interval TRPW reduces.

Therefore, the energization time correction amount TIP that is a correction amount for correcting the energization time TI of the last fuel injection valve 20 is desirably determined on the basis of the fuel pressure Pa in the delivery pipe 54 and the energization start interval TRPW. Therefore, the drive system 10 and the drive method according to the present embodiment prepare a plurality of maps on the basis of the fuel pressure Pa in the delivery pipe 54. Each of the maps shows the correlation between the energization start interval TRPW and the energization time correction amount TIP. The ECU 14 determines the energization time correction amount TIP to a value based on the energization start interval TRPW with the use of a selected one of the maps, based on the fuel pressure Pa.

Figure 19:
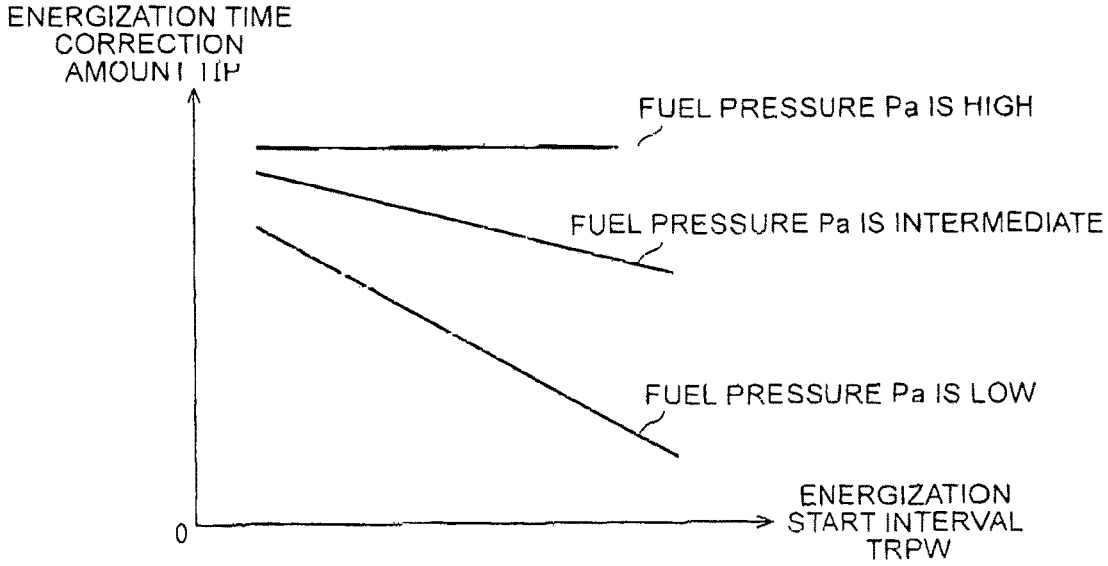
FIG. 19 is a map that shows the correlation between an energization start interval and an energization time correction amount.

FIG. 19 shows a low-pressure map in the case where the fuel pressure Pa is low, a high-pressure map in the case where the fuel pressure Pa is high and an intermediate map in the case where the fuel pressure Pa is intermediate within the map that shows the correlation between the energization start interval TRPW and the energization time correction amount TIP.

As shown in FIG. 19, in the low-pressure map and the intermediate map, the energization time correction amount TIP reduces as the energization start interval TRPW extends. However, in the intermediate map, a variation amount in the energization time correction amount TIP with respect to a variation in the energization start interval TRPW is small as compared to the low-pressure map. When the energization start interval TRPW is about the same, the energization time correction amount TIP that is determined with the use of the intermediate map is larger than the energization time correction amount that is determined with the use of the low-pressure map.

On the other hand, in the high-pressure map, the energization time correction amount TIP is about a constant value irrespective of the length of the energization start interval TRPW. This is because, when the fuel pressure Pa in the delivery pipe 54 increases as the high-pressure map is selected, there is a high possibility that the last fuel injection valve 20 has not opened yet at the second energization start timing irrespective of the length of the energization start interval TRPW. When the energization start interval TRPW is equal, the energization time correction amount TIP that is determined with the use of the high-pressure map is larger than the energization time correction amount that is determined with the use of the low-pressure map or the intermediate map.

Next, a processing routine that is executed by the ECU 14 at the time when the ECU 14 learns the capacitor capacitance CC that is the capacitance of the capacitor 12 will be described with reference to the flowchart shown in FIG. 9 and the map shown in FIG. 20. The processing routine is executed at each preset control cycle.

Figure 9:
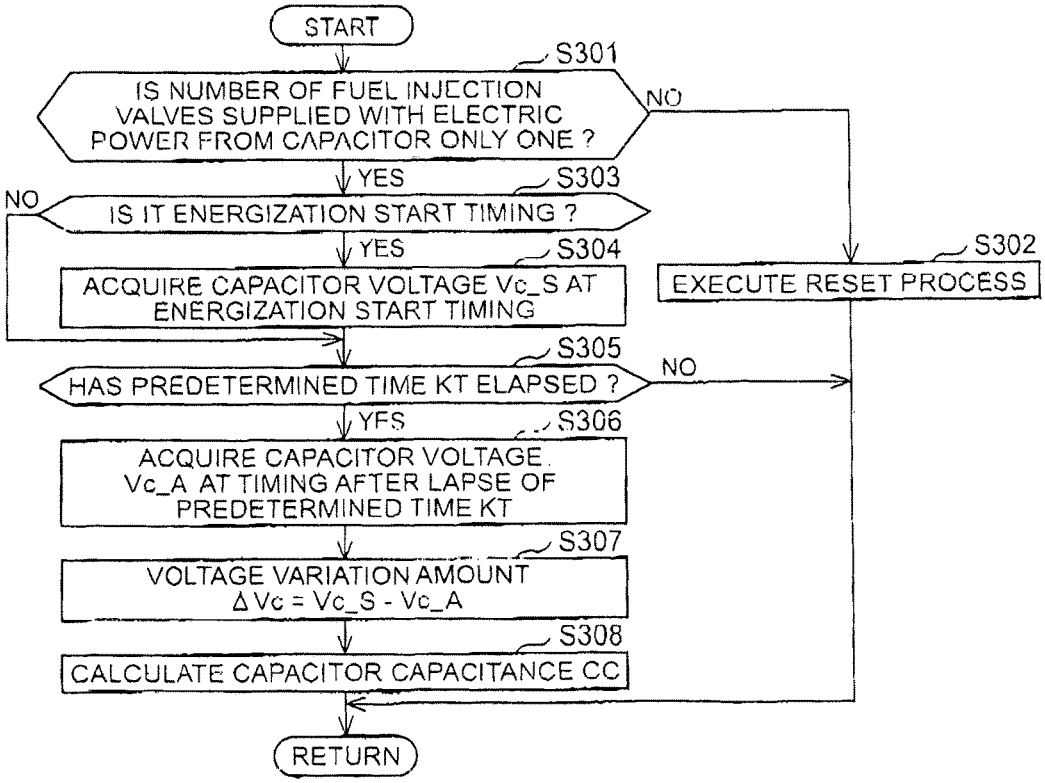
FIG. 9 is a flowchart that illustrates a processing routine that is executed in order to calculate a capacitor capacitance in the control device.

As shown in FIG. 9, in the processing routine, the ECU 14 determines whether the number of the fuel injection valves 20 that are energized from the capacitor 12 is only one (step S301). When the plurality of fuel injection valves 20 are energized from the capacitor 12 or when no fuel injection valve 20 is energized from the capacitor 12 (NO in step S301), the ECU 14 proceeds with the process to the next step S302. In step S302, the ECU 14 executes a reset process for resetting capacitor voltages Vc_S, Vc_A (described later). After that, the ECU 14 once ends the processing routine.

On the other hand, when only one fuel injection valve 20 is energized from the capacitor 12 (YES in step S301), the ECU 14 determines whether the present timing is the energization start timing (step S303). When the present timing is not the energization start timing (NO in step S303), the ECU 14 proceeds with the process to step S305 (described later). On the other hand, when the present timing is the energization start timing (YES in step S303), the ECU 14 sets the detected value of the capacitor voltage, which is detected by the voltage sensor 41, for the capacitor voltage Vc_S at the energization start timing (step S304). The ECU 14 proceeds with the process to the next step S305.

In step S305, the ECU 14 determines whether an elapsed time from the energization start timing has reached a preset predetermined time KT. The predetermined time KT is set to a time shorter than an estimated value of the time from the energization start timing to the peak reach timing. When the predetermined time KT has not elapsed yet (NO in step S305), the ECU 14 once ends the processing routine without calculating the capacitor capacitance CC. On the other hand, when the predetermined time KT has elapsed (YES in step S305), the ECU 14 sets the detected value of the capacitor voltage, detected by the voltage sensor 41 at the timing at which the predetermined time KT has elapsed, for the capacitor voltage Vc_A at the timing after a lapse of the predetermined time KT (step S306).

Subsequently, the ECU 14 subtracts the capacitor voltage Vc_A at the timing after a lapse of the predetermined time KT from the capacitor voltage Vc_S at the energization start timing, and sets the difference (=Vc_S−Vc_A) for a voltage variation amount ΔVc (step S307). The voltage variation amount ΔVc increases as the rate of decrease in the capacitor voltage Vc in the case where one fuel injection valve 20 is energized from the capacitor 12 increases. The ECU 14 leans the capacitor capacitance CC on the basis of the voltage variation amount ΔVc calculated in step S307 (step S308). After that, the ECU 14 once ends the processing routine.

As described above, in the case where the fuel injection valve 20 is energized from the capacitor 12, the rate of decrease in the capacitor voltage Vc increases as the capacitor capacitance CC reduces. In other words, the capacitor capacitance CC reduces as the voltage variation amount ΔVc corresponding to the rate of decrease in the capacitor voltage Vc increases. Therefore, the drive system 10 and the drive method according to the present embodiment calculate the capacitor capacitance CC at that timing with the use of the map shown in FIG. 20.

Figure 20:
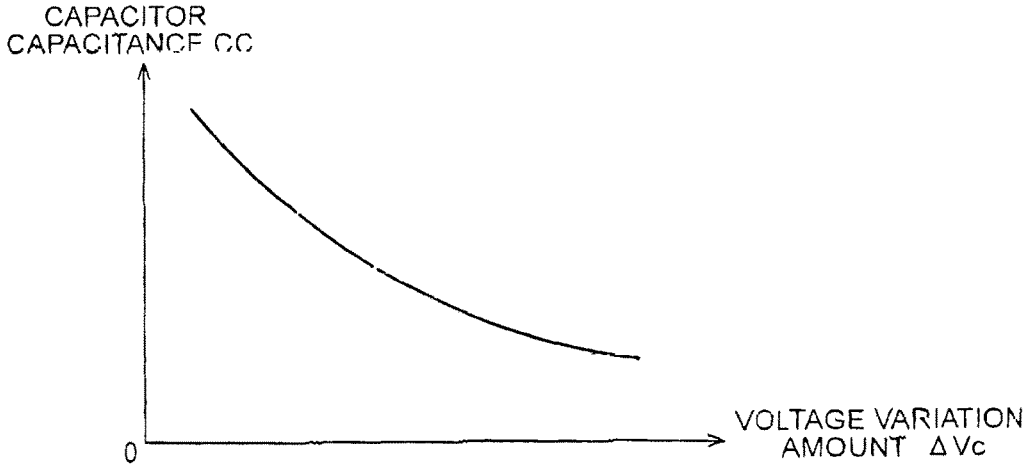
FIG. 20 is a map that shows the correlation between a voltage variation amount and a capacitor capacitance.

FIG. 20 shows the correlation between the voltage variation amount ΔVc and the capacitor capacitance CC. As shown in FIG. 20, the capacitor capacitance CC reduces as the voltage variation amount ΔVc increases. By learning the capacitor capacitance CC with the use of the above map, it is possible to reduce the capacitor capacitance CC as the rate of decrease in the capacitor voltage Vc increases.

Next, the operation at the time of injecting fuel from each fuel injection valve 20 will be described. At the time of injecting fuel from one of the fuel injection valves 20, the energization time TI is set on the basis of the estimated value Vc_Est of the capacitor voltage at that timing. The estimated value Vc_Est of the capacitor voltage is estimated on the basis of the energization start interval TRPW (step S11). The energization start interval TRPW is a time interval between the energization start timing of the current fuel injection valve 20 and the energization start timing of the last fuel injection valve 20 of which energization is started immediately before the former energization start timing.

When the peak reaching time TRPK that is the estimated value from the energization start timing of the last fuel injection valve 20 to the timing at which the exciting current Iinj flowing through the solenoid 21 of the last fuel injection valve 20 reaches the peak current value Ip is shorter than or equal to the energization start interval TRPW (NO in step S104), energization of the last fuel injection valve 20 from the capacitor 12 has already ended. That is, while the capacitor voltage Vc is recovering through charging of the capacitor 12 with electric power supplied from the battery 30 or after completion of recovery of the capacitor voltage Vc, energization of the current fuel injection valve 20 from the capacitor 12 is started. Therefore, by using the above-described relational expression (1), the estimated value Vc_Est of the capacitor voltage is calculated so as to increase as the energization start interval TRPW extends (step S107).

On the other hand, when the peak reaching time TRPK is longer than the energization start interval TRPW (YES in step S104), the last fuel injection valve 20 from the capacitor 12 is still being energized at the energization start timing of the current fuel injection valve 20. That is, there is no period for recovery of the capacitor voltage between the energization start timing of the last fuel injection valve 20 and the energization start timing of the current fuel injection valve 20. Therefore, by using the above-described relational expression (2), the estimated value Vc_Est of the capacitor voltage is calculated so as to decrease as the energization start interval TRPW extends (step S108).

When the estimated value Vc_Est of the capacitor voltage is calculated, the energization correction amount TIR is calculated so as to increase as the estimated value Vc_Est decreases (step S111). By adding the energization correction amount TIR to the base energization time TIB set on the basis of the required injection amount, the energization time TI of the current fuel injection valve 20 is calculated (step S112, step S113). Thus, as the actual capacitor voltage at the energization start timing of the current fuel injection valve 20 decreases, the energization time TI during which the current fuel injection valve 20 is energized from the power supply extends. Thus, even when the capacitor voltage at the energization start timing is low, the amount of fuel that is injected from the current fuel injection valve 20 becomes an amount appropriate to the required injection amount.

In the case where the peak reaching time TRPK is longer than the energization start interval TRPW, if the energization start interval TRPW is significantly short or the fuel pressure Pa in the delivery pipe 54 is high, the last fuel injection valve 20 may be not opened yet at the energization start timing of the current fuel injection valve 20. In this case, the energization time TI of the last fuel injection valve 20 is extended on the basis of the energization start interval TRPW and the fuel pressure Pa (step S201 to step S203). As a result, energization of the current fuel injection valve 20 from the capacitor 12 is started while the last fuel injection valve 20 is being energized from the capacitor 12. Therefore, even when the opening of the last fuel injection valve 20 delays, the amount of fuel that is injected from the last fuel injection valve 20 becomes an amount appropriate to the required injection amount.

According to the above-described configuration and operation, the following advantageous effects are obtained.

(1) In the drive system 10 and the drive method according to the present embodiment, the estimated value Vc_Est of the capacitor voltage at the energization start timing of the fuel injection valve 20 is calculated on the basis of the energization start interval TRPW, and the energization time TI of the fuel injection valve 20 is set on the basis of the estimated value Vc_Est of the capacitor voltage. Thus, it is possible to set the energization time TI of the fuel injection valve 20 that currently starts fuel injection in consideration of a mode of an actual decrease in the voltage of the capacitor 12 from the energization start timing of another fuel injection valve of which energization is started immediately before the start of energization of the current fuel injection valve 20. That is, different from the case where the energization time is set on the basis of the detected value of the voltage of the capacitor 12, which is detected by the detection system, such as the sensor, it is possible to set the energization time TI without any influence of a deviation between the actual rate of change in the voltage of the capacitor 12 and the rate of change in the detected value of the voltage, which is detected by the detection system. Therefore, by setting the energization time TI on the basis of the energization start interval TRPW, it is possible to bring the energization time TI close to a time appropriate to an actual voltage of the capacitor 12 at the second energization start timing. By controlling each fuel injection valve 20 on the basis of the energization time TI, it is possible to inject fuel in an adequate amount appropriate to the required injection amount from each fuel injection valve 20.

(2) When the energization start interval TRPW is longer than or equal to the peak reaching time TRPK, energization of the another one of the fuel injection valves from the capacitor 12 is already ended at the energization start timing of the current fuel injection valve 20. Therefore, when the energization start interval TRPW is longer than or equal to the peak reaching time TRPK, a time during which it is allowed to recover the capacitor voltage Vc reduces as the energization start interval TRPW reduces, so the estimated value Vc_Est of the capacitor voltage at the second energization start timing decreases. Therefore, in the drive system 10 and the drive method according to the present embodiment, when the energization start interval TRPW is longer than or equal to the peak reaching time TRPK, the estimated value Vc_Est of the capacitor voltage is calculated such that the estimated value Vc_Est of the capacitor voltage at the second energization start timing decreases as the energization start interval TRPW reduces. By calculating the estimated value Vc_Est of the capacitor voltage in this way, when the energization start interval TRPW is longer than or equal to the peak reaching time TRPK, it is possible to calculate the estimated value Vc_Est of the capacitor voltage at the second energization start timing in consideration of recovery of the capacitor voltage Vc through charging.

(3) Specifically, by adding a difference, obtained by subtracting the voltage decrease amount ΔVF from the estimated value Vc_Estb of the voltage of the capacitor at the first energization start timing, and a product, obtained by multiplying the energization start interval TRPW by the capacitor voltage increase rate SCUP, together, the estimated value Vc_Est of the capacitor voltage at the second energization start timing is calculated. The voltage decrease amount ΔVF corresponds to the amount of electric charge supplied from the capacitor 12 to the solenoid 21 of the another one of the fuel injection valves in a period from the first energization start timing to the peak reach timing. The product (=TRPW×SCUP) corresponds to the amount of electric charge stored in the capacitor 12 from the battery 30 in a period from the first energization start timing to the second energization start timing. Therefore, when the energization start interval TRPW is longer than or equal to the peak reaching time TRPK, it is possible to calculate the estimated value Vc_Est of the capacitor voltage at the second energization start timing in consideration of both the voltage decrease amount up to the peak reach timing and the amount of recovery of the voltage thereafter by executing the calculation process for adding the voltage decrease amount ΔVF and the product together.

(4) On the other hand, when the energization start interval TRPW is shorter than the peak reaching time TRPK, the another one of the fuel injection valves is still being energized from the capacitor 12 at the energization start timing of the fuel injection valve 20. In the case where the another one of the fuel injection valves is being energized from the capacitor 12, the voltage of the capacitor 12 decreases with a lapse of time from the first energization start timing. Therefore, when the energization start interval TRPW is shorter than the peak reaching time TRPK, the estimated value Vc_Est of the capacitor voltage at the second energization start timing increases as the energization start interval TRPW reduces. In the drive system 10 and the drive method according to the present embodiment, when the energization start interval TRPW is shorter than the peak reaching time TRPK, the estimated value Vc_Est of the capacitor voltage is calculated such that the estimated value Vc_Est of the capacitor voltage at the second energization start timing increases as the energization start interval TRPW reduces. By calculating the estimated value Vc_Est of the capacitor voltage in this way, when the energization start interval TRPW is shorter than the peak reaching time TRPK, it is possible to calculate the estimated value Vc_Est of the capacitor voltage at the second energization start timing in consideration of a decrease in the voltage as the energization start interval TRPW extends.

(5) Specifically, a quotient obtained by dividing the energization start interval TRPW by the peak reaching time TRPK is multiplied by the voltage decrease amount ΔVF, and the estimated value Vc_Est of the capacitor voltage at the second energization start timing is calculated on the basis of the product (=ΔVF×TRPW/TRPK). In this case, the product (=ΔVF×TRPW/TRPK) becomes a value corresponding to the amount of electric charge that is supplied from the capacitor 12 to the fuel injection valve 20 in a period from the first energization start timing to the second energization start timing. Therefore, when the energization start interval TRPW is shorter than the peak reaching time TRPK, it is possible to calculate the estimated value Vc_Est of the capacitor voltage at the second energization start timing in consideration of the amount of decrease in the voltage based on the amount of electric charge that is discharged from the capacitor in a period from the first energization start timing to the second energization start timing by executing the calculation process on the basis of the above product.

(6) A time during which the fuel injection valve 20 is energized from the capacitor 12 extends as the peak reaching time TRPK extends, so it may be estimated that the capacitor voltage Vc is low at the peak reach timing. Therefore, in the drive system 10 and the drive method according to the present embodiment, the voltage decrease amount ΔVF is increased as the peak reaching time TRPK extends. Thus, it is possible to calculate the voltage decrease amount ΔVF in consideration of the influence due to the length of the peak reaching time TRPK.

(7) As the peak current value Ip set for fuel injection of the last fuel injection valve 20 increases, a larger current flows through the solenoid 21 of the last fuel injection valve 20, so the amount of electric charge that is supplied from the capacitor 12 to the last fuel injection valve 20 increases. In this way, as the amount of electric charge that is supplied from the capacitor 12 to the last fuel injection valve 20 increases, the voltage decrease amount ΔVF increases. Therefore, in the drive system 10 and the drive method according to the present embodiment, the voltage decrease amount ΔVF is increased as the peak current value Ip set for fuel injection of the last fuel injection valve 20 increases. Thus, it is possible to calculate the voltage decrease amount ΔVF in consideration of the influence due to the magnitude of the peak current value Ip.

(8) When a constant amount of electric charge is supplied from the capacitor to an object having an equivalent resistance value, the voltage of the capacitor having a small capacitance decreases more easily than the voltage of the capacitor having a large capacitance. Therefore, the voltage decrease amount ΔVF can vary with the capacitor capacitance CC that is the capacitance of the capacitor 12 that energizes each fuel injection valve 20. Therefore, in the drive system 10 and the drive method according to the present embodiment, the value of the voltage decrease amount ΔVF is increased as the capacitor capacitance CC reduces. Thus, it is possible to calculate the voltage decrease amount ΔVF in consideration of the influence of the capacitor capacitance CC.

(9) The rate of increase in the exciting current Iinj can vary with the resistance value of the solenoid 21 at that timing, or the like. The rate of increase in the exciting current Iinj decreases as the resistance value of the solenoid 21 increases, so the peak reaching time TRPK tends to extend. In the drive system 10 and the drive method according to the present embodiment, the rising calculation time T1*c*, which is a calculated value of the time from the energization start timing of the fuel injection valve 20 to the rising detection timing, is calculated as a value corresponding to the rate of increase in the exciting current Iinj, and the peak reaching time TRPK is calculated on the basis of the rising calculation time T1*c*. The thus calculated peak reaching time TRPK extends as the rate of increase in the exciting current Iinj increases. Thus, it is possible to calculate the peak reaching time TRPK in consideration of the rate of increase in the exciting current Iinj at that time.

(10) As the peak current value Ip increases, a time until the exciting current Iinj reaches the peak current value Ip tends to extend. Therefore, the peak reaching time TRPK is allowed to be estimated on the basis of the magnitude of the peak current value Ip set for fuel injection of the fuel injection valve 20. Therefore, in the drive system 10 and the drive method according to the present embodiment, the peak reaching time TRPK is extended as the peak current value Ip increases. Thus, it is possible to calculate the peak reaching time TRPK in consideration of the influence of the magnitude of the peak current value Ip set for fuel injection of the fuel injection valve 20.

(11) In terms of the characteristic of the capacitor, the capacitor voltage Vc tends to fluctuate as the capacitor capacitance CC reduces. Therefore, in the drive system 10 and the drive method according to the present embodiment, the value of the capacitor voltage increase rate SCUP is increased as the capacitor capacitance CC reduces. Because the estimated value Vc_Est of the capacitor voltage at the second energization start timing is calculated by using the capacitor voltage increase rate SCUP, it is possible to highly accurately calculate the estimated value Vc_Est of the capacitor voltage at the second energization start timing in consideration of the influence due to a variation in the capacitor capacitance CC.

(12) At the time of recovering the voltage of the capacitor 12 through charging, it is possible to quickly end charging of the capacitor 12 as the battery voltage VB increases. The battery voltage VB is the voltage of the battery 30 that serves as the power supply. Therefore, it may be estimated that the capacitor voltage increase rate SCUP increases as the battery voltage VB increases. Therefore, in the drive system 10 and the drive method according to the present embodiment, the value of the capacitor voltage increase rate SCUP is increased as the battery voltage VB increases. Because the estimated value Vc_Est of the capacitor voltage at the second energization start timing is calculated by using the capacitor voltage increase rate SCUP, it is possible to highly accurately calculate the estimated value Vc_Est of the capacitor voltage at the second energization start timing in consideration of the influence of the battery voltage VB.

(13) In the case where each fuel injection valve 20 is energized from the capacitor 12, the rate of decrease in the capacitor voltage Vc increases as the capacitor capacitance CC reduces. In other words, the capacitor capacitance CC reduces as the voltage variation amount ΔVc corresponding to the rate of decrease in the capacitor voltage Vc increases. Therefore, in the drive system 10 and the drive method according to the present embodiment, while only one of the fuel injection valves 20 is being energized from the capacitor 12, the voltage variation amount ΔVc corresponding to the rate of decrease in the capacitor voltage Vc is calculated at that time, and the capacitor capacitance CC is calculated on the basis of the voltage variation amount ΔVc. Thus, it is possible to highly accurately calculate the estimated value Vc_Est of the capacitor voltage at the second energization start timing in consideration of the capacitance of the capacitor 12 at that timing by calculating the capacitor capacitance CC on the basis of the voltage variation amount ΔVc and then using the calculated capacitor capacitance CC.

(14) The timing at which each fuel injection valve 20 actually opens tends to be later as the fuel pressure Pa in the delivery pipe 54 increases. Therefore, when the energization start interval TRPW is shorter than the peak reaching time TRPK in a state where the fuel pressure Pa in the delivery pipe 54 is high, the last fuel injection valve 20 sometimes has not opened yet at the second energization start timing. If the current fuel injection valve 20 that starts fuel injection subsequently to the last fuel injection valve 20 is energized from the capacitor 12 in a state where the last fuel injection valve 20 has not opened yet in this way, there is a concern that the open timing of the last fuel injection valve 20 delays.

In the drive system 10 and the drive method according to the present embodiment, when the energization start interval TRPW is shorter than the peak reaching time TRPK, the energization time TI of the last fuel injection valve 20 is corrected so as to extend as the fuel pressure Pa at the energization start timing of the current fuel injection valve 20 increases. Thus, it is possible to suppress a reduction in the injection amount of fuel from the last fuel injection valve 20 beyond an amount appropriate to the required injection amount of the last fuel injection valve 20.

(15) When the last fuel injection valve 20 has not opened yet at the timing at which energization of the current fuel injection valve 20 is started, the open timing of the last fuel injection valve 20 tends to delay as the energization start interval TRPW reduces. Therefore, in the drive system 10 and the drive method according to the present embodiment, when the energization start interval TRPW is shorter than the peak reaching time TRPK, the energization time TI of the last fuel injection valve 20 is corrected so as to extend as the energization start interval TRPW reduces. Thus, it is possible to suppress a reduction in the injection amount of fuel from the last fuel injection valve beyond an amount appropriate to the required injection amount of the last fuel injection valve.

The above-described embodiment may be modified into the following alternative embodiments.

The correction process for correcting the energization time TI of the last fuel injection valve 20 of which energization is started from the capacitor 12 immediately before the start of energization of the current fuel injection valve 20 may be a process that does not use the fuel pressure Pa in the delivery pipe 54 as long as the energization start interval TRPW is used. In this case as well, the energization time TI of the last fuel injection valve 20 is allowed to be extended as the energization start interval TRPW reduces, so an advantageous effect equivalent to the above (15) is obtained.

The sensor value of the fuel pressure, which is detected by the fuel pressure sensor 43, is acquired at preset detection intervals. Therefore, when high-pressure fuel is supplied from the high-pressure fuel pump 53 into the delivery pipe 54 in a period from the timing at which the sensor value is detected last time to the energization start timing, the actual fuel pressure Pa at the energization start timing differs from the sensor value of the fuel pressure, detected by the fuel pressure sensor 43. Therefore, the amount of increase in the fuel pressure from the timing at which the sensor value is detected last time to the energization start timing may be calculated on the basis of the amount of fuel supplied from the high-pressure fuel pump 53 into the delivery pipe 54 in a period from the timing at which the sensor value is detected last time to the energization start timing, and the sum of the addition of the amount of increase and the sensor value may be set for the fuel pressure Pa at the energization start timing. By determining the energization time correction amount TIP on the basis of the thus calculated fuel pressure Pa (see FIG. 19), it is possible to improve the determination accuracy. As a result, it is possible to appropriately correct the energization time TI of the another one of the fuel injection valves, and it is possible to bring the injection amount of fuel from the another one of the fuel injection valves to an amount appropriate to the required injection amount.

As long as it is allowed to ignore variations in the capacitor capacitance CC due to individual difference in terms of manufacturing of the capacitor 12 and aged degradation of the characteristic of the capacitor 12, a preset constant value may be used as the capacitor capacitance CC.

The capacitor voltage increase rate SCUP may be calculated without considering the battery voltage VB at that timing. In this case as well, when the capacitor voltage increase rate SCUP is calculated on the basis of the capacitor capacitance CC, an advantageous effect equivalent to the above (11) is obtained.

The capacitor voltage increase rate SCUP may be calculated without considering the capacitor capacitance CC. In this case as well, when the capacitor voltage increase rate SCUP is calculated on the basis of the battery voltage VB at that timing, an advantageous effect equivalent to the above (12) is obtained.

The peak reaching time TRPK may be calculated on the basis of the rising detection time T1*r* instead of the rising calculation time T1*c*. When such a control configuration is employed as well, it is possible to calculate the peak reaching time TRPK by considering the rate of increase in the exciting current Iinj to a certain extent.

The peak reaching time TRPK may be calculated without considering the magnitude of the peak current value Ip. In this case as well, when the peak reaching time TRPK is calculated on the basis of the rising calculation time T1*c* or the rising detection time T1*r*, an advantageous effect equivalent to the above (9) is obtained.

The peak reaching time TRPK may be calculated without considering the rate of increase in the exciting current Iinj, that is, the rising calculation time Tlc or the rising detection time T1*r*. In this case as well, when the peak reaching time TRPK is calculated on the basis of the peak current value Ip, an advantageous effect equivalent to the above (10) is obtained.

The voltage decrease amount ΔVF may be calculated without considering the peak current value Ip or the peak reaching time TRPK. In this case as well, when the voltage decrease amount ΔVF is calculated on the basis of the capacitor capacitance CC, an advantageous effect equivalent to the above (8) is obtained. Of course, the voltage decrease amount ΔVF may be calculated on the basis of the capacitor capacitance CC and the peak current value Ip or may be calculated on the basis of the capacitor capacitance CC and the peak reaching time TRPK.

The voltage decrease amount ΔVF may be calculated without considering the capacitor capacitance CC or the peak reaching time TRPK. In this case as well, when the voltage decrease amount ΔVF is calculated on the basis of the peak current value Ip, an advantageous effect equivalent to the above (7) is obtained. Of course, the voltage decrease amount ΔVF may be calculated on the basis of the peak current value Ip and the capacitor capacitance CC or may be calculated on the basis of the peak current value Ip and the peak reaching time TRPK.

The voltage decrease amount ΔVF may be calculated without considering the peak current value Ip or the capacitor capacitance CC. In this case as well, when the voltage decrease amount ΔVF is calculated on the basis of the peak reaching time TRPK, an advantageous effect equivalent to the above (6) is obtained. Of course, the voltage decrease amount ΔVF may be calculated on the basis of the peak reaching time TRPK and the peak current value Ip or may be calculated on the basis of the peak reaching time TRPK and the capacitor capacitance CC.

There is an internal combustion engine in which the peak current value Ip is fixed to a constant value, and a variation in the peak reaching time TRPK does not occur due to a change in the peak current value Ip in such an internal combustion engine. Furthermore, in the case where variations in the voltage decrease amount ΔVF and the capacitor voltage increase rate SCUP are vanishingly small, when the energization start interval TRPW is longer than or equal to the peak reaching time TRPK, the energization correction amount TIR is allowed to be calculated on the basis of only the energization start interval TRPW. In this case, for example, with the use of the map shown in FIG. 21, it is possible to determine the energization correction amount TIR without estimating the capacitor voltage Vc at the energization start timing.

Figure 21:
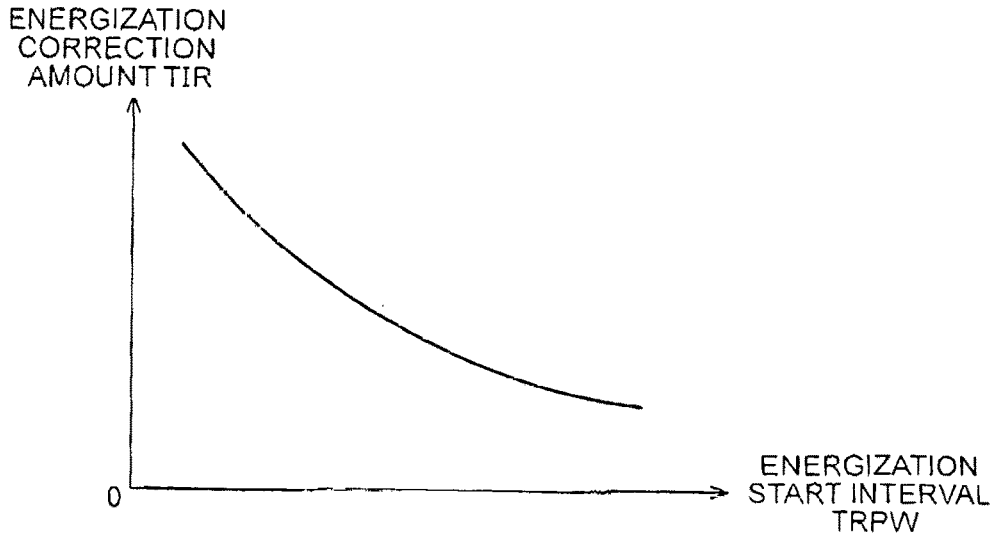
FIG. 21 is a map that shows the correlation between an energization start interval and an energization correction amount at the time of correcting an energization time in a drive system according to another embodiment.

The map shown in FIG. 21 is a map that shows the correlation between the energization start interval TRPW and the energization correction amount TIR. As shown in FIG. 21, the energization correction amount TIR reduces as the energization start interval TRPW extends. By adding the thus calculated energization correction amount TIR to the base energization time TIB set on the basis of the required injection amount, it is possible to calculate the energization time TI.

That is, when fuel injection from each of the fuel injection valves 20 is controlled such that the energization start interval TRPW is not shorter than the peak reaching time TRPK, the energization time TI of the current fuel injection valve 20 may be calculated so as to extend as the energization start interval TRPW reduces. In this case as well, different from the case where the energization time is set on the basis of the detected value of the voltage of the capacitor, which is detected by the detection system, such as the sensor, it is possible to set the energization time TI without any influence of a deviation between the actual rate of change in the voltage of the capacitor and the rate of change in the detected value of the voltage, which is detected by the detection system. Therefore, it is possible to bring the energization time TI close to a time appropriate to the actual voltage of the capacitor at the energization start timing of the fuel injection valve that starts fuel injection. By controlling each fuel injection valve 20 on the basis of the above energization time TI, it is possible to inject fuel in an adequate amount appropriate to the required injection amount from the fuel injection valve 20.

The invention claimed is:

1. A drive system for fuel injection valves, comprising:

a battery;

a capacitor configured to be charged with electric power that is supplied from the battery;

drive control circuitry configured to selectively use one of the battery and the capacitor as a power supply, and to open or close a plurality of fuel injection valves by controlling energization of the plurality of fuel injection valves from one of the battery and the capacitor, the plurality of fuel injection valves including a second fuel injection valve currently injecting fuel and a first fuel injection valve which, of the plurality of fuel injection valves, last started energizing before the second fuel injection valve, the energization of the second fuel injection valve starting while the energization of the first fuel injection valve continues; and electronic control circuitry configured to:

(a) cause the plurality of fuel injection valves to inject fuel by energizing the plurality of fuel injection valves through control of the drive control circuitry, (b) when an energization start interval between a start of energization of the first fuel injection valve and a start of energization of the second fuel injection valve is longer than or equal to a peak reaching time of the first fuel injection valve at the time when fuel is sequentially injected from the plurality of fuel injection valves, extend an energization time of the second fuel injection valve as the energization start interval reduces, the peak reaching time being a time interval between a first energization start timing and a peak reach timing, the first energization start timing being a timing of the start of energization of the first fuel injection valve, and the peak reach timing being a timing at which exciting current flowing through a solenoid of the first fuel injection valve reaches a peak current value that is set at the time of fuel injection of the first fuel injection valve, the energization start interval being a time interval between the first energization start timing and a second energization start timing that is a timing of the start of energization of the second fuel injection valve, and (c) when the energization start interval is shorter than the peak reaching time, reduce the energization time of the second fuel injection valve as the energization start interval reduces.

2. The drive system according to claim 1, wherein the electronic control circuitry is configured to:

(d) when the energization start interval is longer than or equal to the peak reaching time, decrease a voltage estimated value of the capacitor at the second energization start timing as the energization start interval reduces, (e) when the energization start interval is shorter than the peak reaching time, increase the voltage estimated value of the capacitor at the second energization start timing as the energization start interval reduces, and (f) extend the energization time of the second fuel injection valve, of which energization is started from the second energization start timing, as the voltage estimated value of the capacitor at the second energization start timing decreases.

3. The drive system according to claim 2, wherein the electronic control circuitry is configured to, when the energization start interval is longer than or equal to the peak reaching time, calculate the voltage estimated value of the capacitor at the second energization start timing by adding a value, obtained by subtracting a voltage decrease amount from a value of voltage of the capacitor at the first energization start timing, and a value, obtained by multiplying a value of the energization start interval by a capacitor voltage increase rate, together, the voltage decrease amount is an amount of decrease in the voltage of the capacitor through energization of the first fuel injection valve from the capacitor in a period from the first energization start timing to the peak reach timing, and the capacitor voltage increase rate is a rate of recovery of the voltage of the capacitor at the time when the voltage of the capacitor is recovered through charging of the capacitor with electric power that is supplied from the battery.

4. The drive system according to claim 2, wherein the electronic control circuitry is configured to, when the energization start interval is shorter than the peak reaching time, decrease the voltage estimated value of the capacitor at the second energization start timing as a value obtained by multiplying a value, obtained by dividing a value of the energization start interval by a value of the peak reaching time, by a voltage decrease amount increase, and the voltage decrease amount is an amount of decrease in the voltage of the capacitor through energization of the first fuel injection valve from the capacitor in a period from the first energization start timing to the peak reach timing.

5. The drive system according to claim 3, wherein the electronic control circuitry is configured to calculate the voltage decrease amount such that the voltage decrease amount increases as the peak reaching time extends.

6. The drive system according to claim 3, wherein the electronic control circuitry is configured to calculate the voltage decrease amount such that the voltage decrease amount increases as the peak current value set for fuel injection from the fuel injection valve increases.

7. The drive system according to claim 3, wherein the electronic control circuitry is configured to calculate the voltage decrease amount such that the voltage decrease amount increases as a capacitance of the capacitor reduces.

8. The drive system according to claim 3, wherein the electronic control circuitry is configured to calculate a value of the peak reaching time such that the value of the peak reaching time increases as a time from the first energization start timing to rising detection timing extends, and the rising detection timing is a timing at which the exciting current flowing through the solenoid of the fir fuel injection valve exceeds a prescribed current value smaller than the peak current value in process in which the exciting current increases.

9. The drive system according to claim 2, wherein the electronic control circuitry is configured to calculate the peak reaching time such that the peak reaching time extends as the peak current value increases.

10. The drive system according to claim 3, wherein the electronic control circuitry is configured to calculate the capacitor voltage increase rate such that the capacitor voltage increase rate increases as a capacitance of the capacitor reduces.

11. The drive system according to claim 3, wherein the electronic control circuitry is configured to calculate the capacitor voltage increase rate such that the capacitor voltage increase rate increases as a voltage of the battery increases.

12. The drive system according to claim 7, wherein the electronic control circuitry is configured to:

(g) calculate a learning value of the capacitance of the capacitor; and (h) calculate the learning value of the capacitance of the capacitor such that the learning value reduces as a rate of decrease in a detected value of the voltage of the capacitor at the time when each of the fuel injection valves is energized from the capacitor increases.

13. The drive system according to claim 1, wherein the electronic control circuitry is configured to, when the energization start interval is shorter than the peak reaching time, extend the energization time of the first fuel injection valve as a fuel pressure in a delivery pipe increases.

14. The drive system according to claim 1, wherein the electronic control circuitry is configured to, when the energization start interval is shorter than the peak reaching time, extend an energization time of the first fuel injection valve as the energization start interval reduces.

15. A drive method for fuel injection valves, a capacitor configured to be charged with electric power that is supplied from a battery, drive control circuitry configured to selectively use one of the battery and the capacitor as a power supply and to open or close a plurality of fuel injection valves by controlling energization of the plurality of fuel injection valves from one of the battery and the capacitor, the plurality of fuel injection valves including a second fuel injection valve currently injecting fuel and a first fuel injection valve which, of the plurality of fuel injection valves, last started energizing before the second fuel injection valve, the energization of the second fuel injection valve starting while the energization of the first fuel injection valve continues, and electronic control circuitry configured to cause the plurality of fuel injection valves to inject fuel by energizing the plurality of fuel injection valves through control of the drive control circuitry, the drive method comprising:

(a) controlling the drive control circuitry with the use of the electronic control circuitry such that the plurality of fuel injection valves are caused to sequentially inject fuel by energizing the plurality of fuel injection valves;

(b) controlling the drive control circuitry with the use of the electronic control circuitry such that, when an energization start interval between a start of energization of the first fuel injection valve and a start of energization of the second fuel injection valve is longer than or equal to a peak reaching time of the first fuel injection valve an energization time of the second fuel injection valve is extended as the energization start interval reduces, the peak reaching time being a time interval between a first energization start timing and a peak reach timing, the first energization start timing being a timing of the start of energization of the first fuel injection valve, and the peak reach timing being a timing at which exciting current flowing through a solenoid of the first fuel injection valve reaches a peak current value that is set at the time of fuel injection of the first fuel injection valve, the energization start interval being a time interval between the first energization start timing and second energization start timing that is g timing of the start of energization of the second fuel injection valve, and (c) controlling the drive control circuitry with the use of the electronic control circuitry such that, when the energization start interval is shorter than the peak reaching time, the energization time of the second fuel injection valve is reduced as the energization start interval reduces.

* * * * *